US007423619B2

(12) United States Patent
De Smet et al.

(10) Patent No.: US 7,423,619 B2
(45) Date of Patent: Sep. 9, 2008

(54) REFRESH PIXEL CIRCUIT FOR ACTIVE MATRIX

(75) Inventors: Herbert De Smet, Destelbergen (BE); Jean Van Den Steen, Dendermonde (BE); Geert Van Doorselaer, Assebroek (BE); André Van Calster, Heusden (BE)

(73) Assignee: Gemidis N.V., Ghent (BG)

( * ) Notice: Subject to any disclaimer, the term of this patent is extended or adjusted under 35 U.S.C. 154(b) by 619 days.

(21) Appl. No.: 10/517,308

(22) PCT Filed: Jun. 24, 2003

(86) PCT No.: PCT/BE03/00108

§ 371 (c)(1),
(2), (4) Date: Dec. 17, 2004

(87) PCT Pub. No.: WO04/001715

PCT Pub. Date: Dec. 31, 2003

(65) Prior Publication Data

US 2006/0007192 A1 Jan. 12, 2006

(30) Foreign Application Priority Data

Jun. 24, 2002 (GB) ..... 0214468.1

(51) Int. Cl.
*G09G 3/36* (2006.01)

(52) U.S. Cl. ..... 345/89; 345/94; 345/96; 345/204; 345/205; 345/206

(58) Field of Classification Search ..... 345/89, 345/94, 96, 204–206
See application file for complete search history.

(56) References Cited

U.S. PATENT DOCUMENTS 5,402,128 A * 3/1995 Kusumoto et al. ..... 341/172
6,304,239 B1 * 10/2001 McKnight ..... 345/87
7,038,671 B2 * 5/2006 Willis et al. ..... 345/205

FOREIGN PATENT DOCUMENTS

WO WO 01 77747 10/2001
WO WO 01 95619 12/2001
WO WO 02 27700 4/2002

OTHER PUBLICATIONS

S.C. Tan and X.W. Sun, P-1: Generic design of silicon backplane for LCoS microdisplays, SID 02 Digest, pp. 200-203.

* cited by examiner

*Primary Examiner*—Richard Hjerpe
*Assistant Examiner*—Leonid Shapiro
(74) *Attorney, Agent, or Firm*—Bacon & Thomas, PLLC

(57) ABSTRACT

The present invention provides an array of pixels, each pixel comprising: a pixel element, a pixel refresh circuit, a first memory element and a first switch element. Each pixel element comprises a first pixel electrode for individual control of the pixel element and a second pixel electrode, the second pixel electrode linking substantially all pixel elements in the array and being connected to a common counter-electrode. The first and second pixel electrode form a first capacitor. The pixel element has a threshold voltage and a modulation voltage. The pixel refresh circuit is intended for transferring electric charge related to a pixel data value from a data input of the pixel to the first pixel electrode via a charge transfer path. The first memory element is coupled to the pixel data input for storing electric charge related to the pixel data value. The first switch element is located between the first memory element and the first pixel electrode, and is for controlling charge transfer from the first memory element through the charge transfer path to the first pixel electrode. According to the present invention, the first switch element and the first memory element co-operate to transfer charge related to the pixel data value passively along the charge transfer path to the first capacitor. According to the present invention, the array further comprises means for applying a dynamically changing voltage to the common counter-electrode, the dynamically changing voltage changing between a first driving value and a second driving value so that the pixel data value is a signal comprised between zero volts and a data voltage value, the data voltage value being not smaller than the modulation voltage and smaller than the sum of the modulation voltage and the threshold voltage of any of the pixels elements. The present invention also provides a method for refreshing pixel values of an array of pixels.

35 Claims, 16 Drawing Sheets

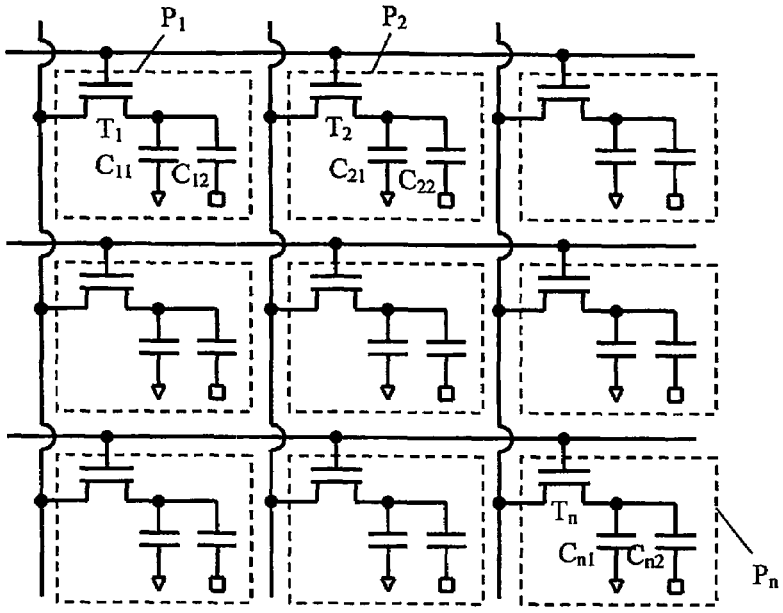
Fig. 1 - Prior Art
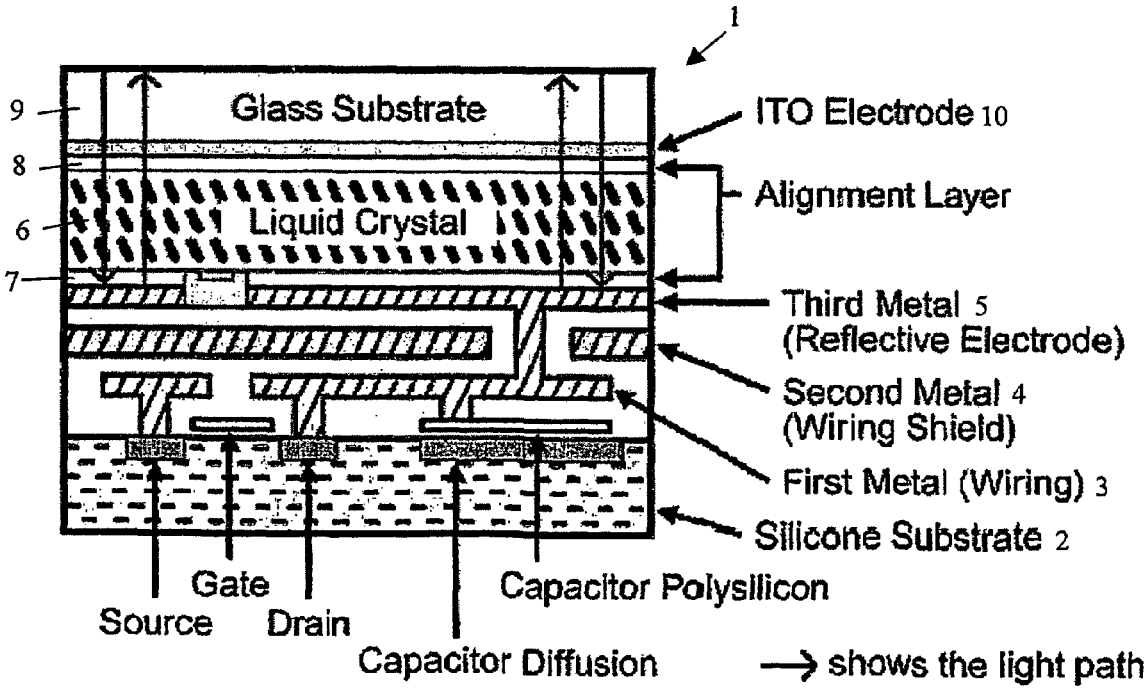
Fig. 2

REFRESH PIXEL CIRCUIT FOR ACTIVE MATRIX

TECHNICAL FIELD OF THE INVENTION

The present invention relates to active matrix displays in general, and to active matrix displays with small pixels, such as e.g. LCOS displays, more particularly, as well as to methods of driving such displays and displaying information.

BACKGROUND OF THE INVENTION

A conventional active matrix (AM) is shown in FIG. 1. It comprises a matrix of crossing rows and columns of liquid crystal (LC) pixels $P_1, P_2, \ldots, P_n$. At each cross-point of those rows and columns, switching transistors $T_1, T_2, \ldots, T_n$ are provided. Every pixel $P_1, P_2, \ldots, P_n$ also comprises two capacitors: a storage capacitor $C_{11}, C_{21}, \ldots, C_{n1}$ which keeps the voltage across the LC constant between two refresh moments, and an intrinsic (parasitic) pixel capacitance $C_{12}, C_{22}, \ldots, C_{n2}$, formed by the liquid crystal stack (pixel electrode—LC—counter-electrode) itself. When the switching transistors $T_i$ of one row are closed (=made conductive), the respective column voltages are stored on the respective storage capacitors $C_{i1}$ of the pixels $P_i$ of that row.

Liquid Crystal on Silicon (LCOS) is a special type of reflective active matrix (AM) liquid crystal displays (LCD), wherein the AM is implemented in a standard silicon process.

A cross-section of a LCOS 1 is shown in FIG. 2. It comprises a semiconductor substrate 2, such as a silicon substrate, with integrated CMOS transistors, and comprises different layers such as a first metal layer 3, a second metal layer 4 and a third metal layer 5 (generally at least four metal layers are provided). On top of the CMOS chip, an LC layer 6 is provided between two alignment layers 7, 8. Thereupon, a glass substrate 9 is provided with an Indium Tin Oxide (ITO) counter-electrode 10, ITO being a conductive and transparent material.

The LC does not operate correctly with a DC voltage, i.e. the pixel voltage has to change in time, the mean value of the pixel voltage (in time) being zero. The electro-optical response of a LC pixel is given in FIG. 3, in a graph in function of the RMS (root-mean-square) voltage. It can be seen that a certain threshold voltage $V_{th}$ needs to be applied before the LC starts transmitting or reflecting light (depending on the kind of LC).

From the electro-optical response of the LC it can be seen that only a limited part of the curve is suitable for practical implementation. This part is called the "modulation area", and it is located between a threshold voltage $V_{th}$ and an inversion voltage $V_{inv}$. In Vertically Aligned Nematic (VAN) LC types, the threshold voltage $V_{th}$ is typically about 2 V, and the modulation voltage $V_m$ is typically about 1 V. With a constant counter-electrode voltage, the pixel electrode must go over a voltage span of 2*(2 V+1 V)=6 V. These voltage values can be quite different for other types of LC.

However, as LCOS is basically a CMOS technology complemented with LC technology, the advantages of CMOS also hold for LCOS. In particular, costs decrease for larger wafers and smaller dimensions of devices on the wafers. At present, in CMOS 0.35 μm processes are used on 8 inch wafers. The maximum gate voltage for transistor devices made in this CMOS process is 3.3 to 3.5 V. This does not seem to be compatible with the voltages required to control the LC.

This problem can be solved by switching the counter-electrode voltage, also called voltage modulation of the common electrode, as described in U.S. Pat. No. 5,920,298.

In an article of S. C. Tan and X. W. Sun, "P-1: Generic design of Silicon Backplane for LCOS Microdisplays", SID 02 Digest, pp. 200-203, the use of voltage modulation of the common electrode in an LCOS display is described. The voltage on the common electrode is switched between 0 V and the voltage VDD between the two supply rails, in the positive and negative frames respectively. Positive potential across the LC cell is obtained when the voltage applied is referred to the 0 V common cathode, while negative potential is obtained when the voltage on the common electrode is switched to VDD and the applied voltage is less than VDD. This method allows a supply of the same voltage as the LC operating voltage to be used and thus is a low power implementation.

A refresh pixel circuit based on the counter-electrode switching is also described by Tan et al. in the same document. Pixel data from a data line is transferred via a switch or access transistor towards an intermediate storage capacitor, which holds the image data. An in-pixel buffer serves to replicate the voltage stored on the intermediate storage capacitor on a final storage capacitor, from which the pixel data is put on the pixel electrode. The in-pixel buffer presented in the document is either a PMOS source follower or an NMOS source follower. In both cases there is at least a threshold voltage loss over the in-pixel circuitry transistors. This loss decreases the maximum remaining voltage. Moreover, a source follower requires a current source. The current generated by this current source has to be exactly equal all over the chip for each pixel. Another problem is the total power consumption, as the pixel count is typically more than 1 million pixels. This can be solved by pulsed current sources, which in turn require more transistors for each pixel and thus more space on the chip.

SUMMARY OF THE INVENTION

It is an object of the present invention to reduce the area needed by the addressing circuitry underneath a pixel. The area needed is lower than 15 μm×15 μm, preferably lower than 12 μm×12 μm, still more preferred it is about 7 μm×7 μm.

It is a further object of the present invention to provide a display device and a method for transferring image pixel data from an analog memory device to a pixel element of the display device with reduced energy loss.

It is a further object of the present invention to provide a display device and a method for transferring image pixel data from an analog memory device to a pixel element of the display device using less components.

The above objectives are accomplished by a method and device according to the present invention.

The present invention provides an array of pixels, each pixel comprising: a pixel element, a pixel refresh circuit, a first memory element and a first switch element. Each pixel element comprises a first pixel electrode for individual control of the pixel element and a second pixel electrode, the second pixel electrode linking substantially all pixel elements in the array and being connected to a common counter-electrode. The first and second pixel electrode form a first capacitor. The pixel element has a threshold voltage, being a voltage at which the pixel element starts to emit light, and a modulation voltage, which is a practically useful voltage range over which the pixel element emits light. The pixel refresh circuit is intended for transferring electric charge related to a pixel data value from a data input of the pixel to the first pixel electrode via a charge transfer path. The first memory element is coupled to the pixel data input for storing electric charge related to the pixel data value. The first switch element is located between the first memory element and the first pixel electrode, and is for controlling charge transfer from the first memory element through the charge transfer path to the first pixel electrode. According to the present invention, the first switch element and the first memory element co-operate to transfer charge related to the pixel data value passively along the charge transfer path to the first capacitor. The array further comprises means for applying a dynamically changing voltage to the common counter-electrode. This dynamically changing voltage changes between a first driving value and a second driving value so that the pixel data value is a signal comprised between zero volts and a data voltage value, the data voltage value being not smaller than the modulation voltage and smaller than the sum of the modulation voltage and the threshold voltage of any of the pixel elements.

The first driving value preferably equals minus the threshold voltage of the pixel elements, and the second driving value preferably equals the sum of the threshold voltage and the modulation voltage of the pixel elements. This way, the dynamically changing voltage at the counter-electrode absorbs the threshold voltage of the pixel element.

According to an embodiment of the present invention, the first memory element has a first and a second electrode, the first electrode being coupled to the pixel data input, and the second electrode being coupled to ground level.

According to a further embodiment of the present invention, each pixel may further comprise conversion means for converting a stored amount of electric charge related to the pixel data value into a pulse with a pulse width for control of the pixel element, the pulse width corresponding to the stored amount of electric charge.

The conversion means may comprise a comparator device.

The comparator device may comprise a switching circuit and a wave-shaping circuit.

The switching circuit may comprise a resistive load inverter. The resistive load inverter may have a first and a second supply connection for connecting to lower supply voltage and a higher supply voltage respectively, wherein any of the first or second supply connection are connected to a sloping or ramping voltage source.

The wave-shaping circuit may comprise at least one complementary inverter.

According to an alternative embodiment, the comparator may comprise a shunting resistive device and an inverter. The shunting resistive device may for example be a resistor or a transistor with a pulsed gate signal with a low duty ratio, or it may comprise a current mirror.

The comparator may furthermore comprise at least one current limiting transistor.

According to preferred embodiments of the present invention, the conversion means comprises less than 10 transistors, preferably less than 8 transistors, still more preferred less than 5 transistors.

According to a further embodiment, charge related to the pixel data value when stored in the first memory element generates a data voltage across the first memory element and the passive charge transfer applies substantially the same voltage as the data voltage on the first pixel electrode.

According to an embodiment, the pixel refresh circuit may further comprise a mirroring circuit, for losslessly mirroring the pixel data value stored on the first memory element to the first pixel electrode of the pixel element. The mirroring circuit may comprise the first switch element having a first and a second data electrode and a control electrode, the first switch element being connected with its first data electrode to an electrode of the first memory element and with its second data electrode to the first pixel electrode, a second memory element for storing data values, the second memory element having a first and a second electrode, the second memory element being connected with its first electrode to the second data electrode of the first switch element, and with its second electrode to the control electrode of the first switch element, and resetting means, for resetting the data value stored in the second memory element.

Alternatively, in an array according to the present invention the pixel refresh circuit of each pixel comprises a plurality of first memory elements, each first memory element being intended to store a pixel data value, each memory element having a charge transfer path between the plurality of first memory elements and the first pixel electrode, and a plurality of first switch elements, each first switch element for controlling charge transfer from a first memory element through the respective charge transfer path to the first pixel electrode, the first switch elements of one pixel intended to be closed mutually exclusively.

An array according to the present invention may furthermore comprise a second switch element between the first memory element and a data line for providing pixel data values.

The pixel element may comprise a liquid crystal, for example an LCOS element.

The first memory element(s) may be (a) storage capacitor(s).

The second memory element may be a storage capacitor.

The first and second switch element may be a transistor.

The array may be an active matrix.

According to a further embodiment, the present invention also provides an array of pixels, each pixel comprising: a pixel element, a pixel refresh circuit, a first memory element and a first switch element. Each pixel element comprises a first pixel electrode for individual control of the pixel element and a second pixel electrode, the second pixel electrode linking substantially all pixel elements in the array and being connected to a common counter-electrode. The first and second pixel electrode form a first capacitor. The pixel refresh circuit is intended for transferring electric charge related to a pixel data value from a data input of the pixel to the first pixel electrode via a charge transfer path. The first memory element is coupled to the pixel data input for storing electric charge related to the pixel data value. The first switch element is located between the first memory element and the first pixel electrode, and is for controlling charge transfer from the first memory element through the charge transfer path to the first pixel electrode. According to the present invention, the first switch element and the first memory element co-operate to transfer charge related to the pixel data value passively along the charge transfer path to the first capacitor. The pixel refresh circuit comprises a mirroring circuit, for losslessly mirroring the pixel data value stored on the first memory element to the first pixel electrode of the pixel element. The mirroring circuit comprises the first switch element having a first and a second data electrode and a control electrode, the first switch element being connected with its first data electrode to an electrode of the first memory element and with its second data electrode to the first pixel electrode, a second memory element for storing data values, the second memory element having a first and a second electrode, the second memory element being connected with its first electrode to the second data electrode of the first switch element, and with its second electrode to the control electrode of the first switch element, and resetting means, for resetting the data value stored in the second memory element.

The present invention also provides a method for refreshing pixel values of an array of pixels, each pixel comprising a pixel element comprising a first pixel electrode for individual control of the pixel element and a second pixel electrode, the second electrode of substantially all pixel elements in the array being connected to a common counter-electrode, the pixel element having a threshold voltage and a modulation voltage. The method comprises passively transferring charge related to pixel data to the first pixel electrode and applying a dynamically changing voltage to the common counter-electrode, the dynamically changing voltage changing between a first driving value and a second driving value so that the pixel data is a signal comprised between zero volts and a data voltage value, the data voltage value being not smaller than the modulation voltage and smaller than the sum of the modulation voltage and the threshold voltage of any of the pixel elements.

The first driving value preferably equals minus the threshold voltage of the pixel elements, and the second driving value preferably equals the sum of the threshold voltage and the modulation voltage of the pixel elements. This way, the dynamically changing voltage at the counter-electrode absorbs the threshold voltage of the pixel element.

According to an embodiment of the present invention, the method furthermore comprises storing the charge related to pixel data and converting the stored charge into a pulse with a pulse width for control of the pixel element, the pulse width corresponding to an amount of stored charge.

The present invention furthermore comprises a method for refreshing pixel values of an array of pixels, each pixel comprising a pixel element comprising a first pixel electrode for individual control of the pixel element and a second pixel electrode, the second electrode of substantially all pixel elements in the array being connected to a common counter-electrode. The method comprises passively transferring charge related to pixel data to the first pixel electrode, storing the charge related to pixel data and converting the stored charge into a pulse with a pulse width for control of the pixel element, the pulse width corresponding to an amount of stored charge.

In both embodiments of the method, the step of passively transferring pixel data may comprise losslessly mirroring the data from a first memory element to the first pixel electrode of the pixel element.

According to an embodiment of the present invention, the step of passively transferring pixel data comprises transferring the data from either of a set of memory elements over one switch element from a plurality of mutually exclusively driven switch elements.

These and other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a schematic diagram of an active matrix according to the prior art.

FIG. 2 is a cross-section of an LCOS device.

FIG. 20(*b*) shows simulation results of a circuit of FIG. 20(*a*) for different input data signals.

FIG. 21(*b*) shows simulation results of a circuit of FIG. 21(*a*) for different input data signals.

FIG. 22(*b*) shows simulation results of a circuit of FIG. 22(*a*) for different input data signals.

DESCRIPTION OF ILLUSTRATIVE EMBODIMENTS

Figure 3:
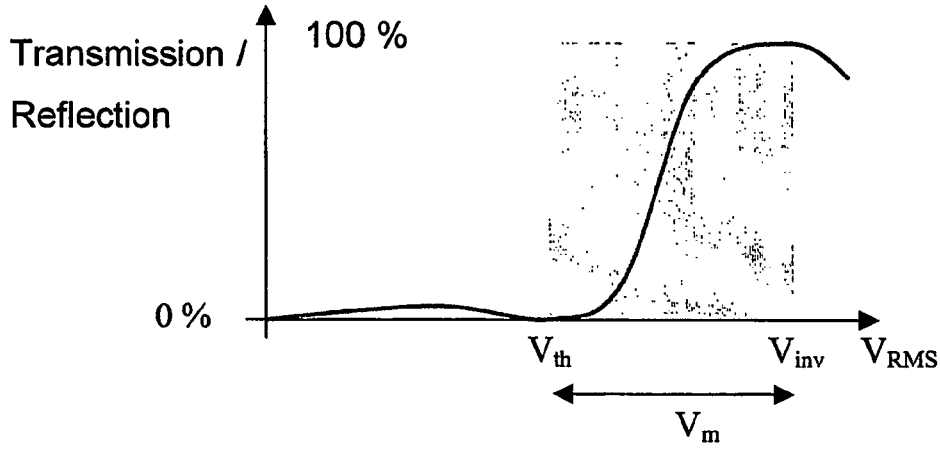
FIG. 3 is a graph showing the electro-optical characteristic of a liquid crystal.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes.

LCOS displays can display colour images. Generally, colour images are made with LCOS pixels in any of two ways: by means of a 3-valve optical engine or by means of a 1-valve optical engine. However, also two-valve optical engines have already been reported, with one LCOS-valve for green, and one LCOS-valve for red+blue.

Figure 4:
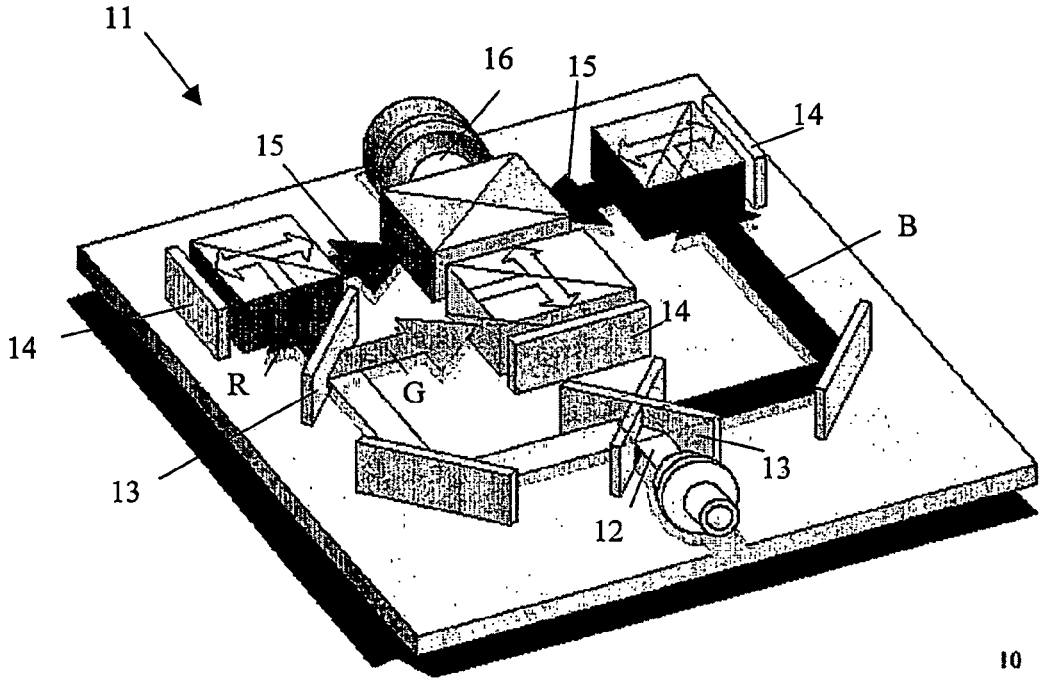
FIG. 4 is a schematic representation of a 3-valve optical engine for projecting colour images by means of LCOS pixels.
Figure 5:
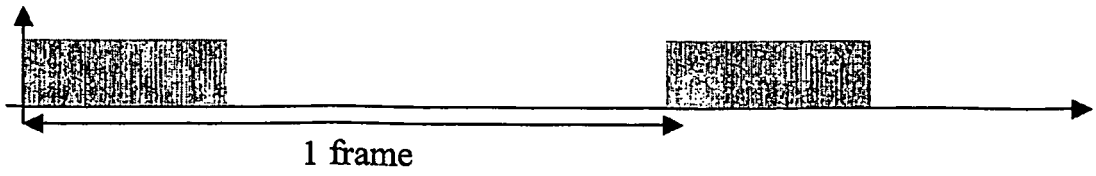
FIG. 5 is a graph representing the light output of 1 light valve in function of time in case there are 3 light valves, with a small duty cycle (about 33%).
Figure 6:
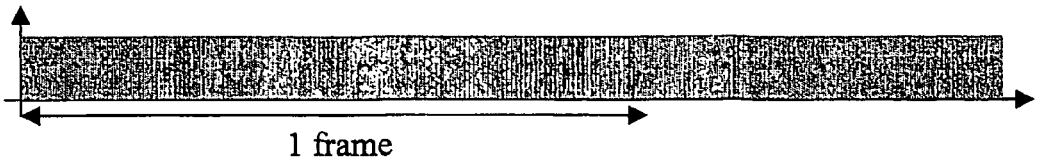
FIG. 6 is a graph representing the light output of 1 light valve in function of time in case there are 3 light valves, with a duty cycle of 100%.
Figure 12:
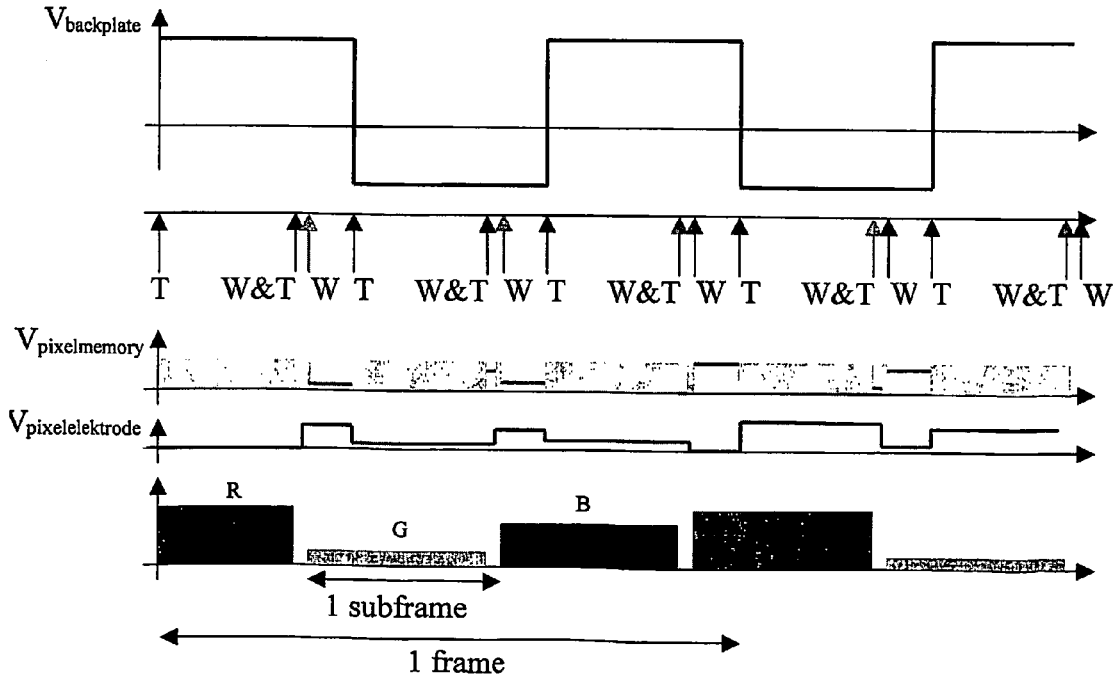
FIG. 12 is a timing diagram of one pixel or row in a counter-electrode switching scheme in a 1-valve optical system with scrolling colour.

A schematic representation of a 3-valve optical engine 11 is given in FIG. 4. Incoming light 12 is split by dichroic mirrors 13 into red R, green G and blue B components, and each of these components R, G, B is directed onto LCOS cells 14. The three reflected light beams 15 are brought together again and the compound light beam 16 is projected (in case of projection), or imaged on the retina (in case of near to the eye (NTE) applications). Each pixel is illuminated, either continuously or not, with light of only one colour (FIG. 5 and FIG. 6). In case of projection it is important to have as much light on the projection screen as possible. In this case, the duty cycle will be kept as large as possible, preferably 100% as shown in FIG. 12.

Figure 7:
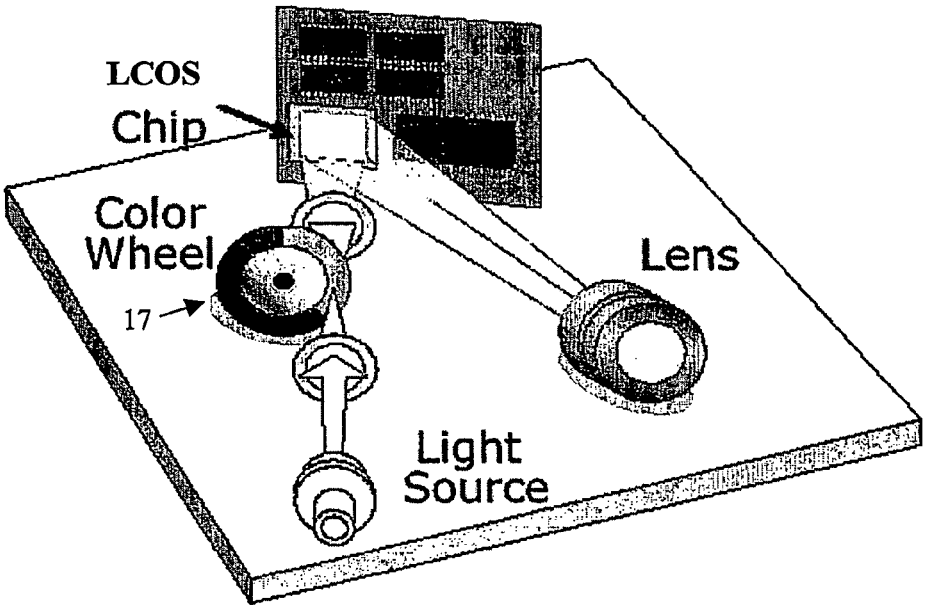
FIG. 7 is a schematic representation of a 1-valve optical engine for projecting colour images by means of LCOS pixels.
Figure 8:
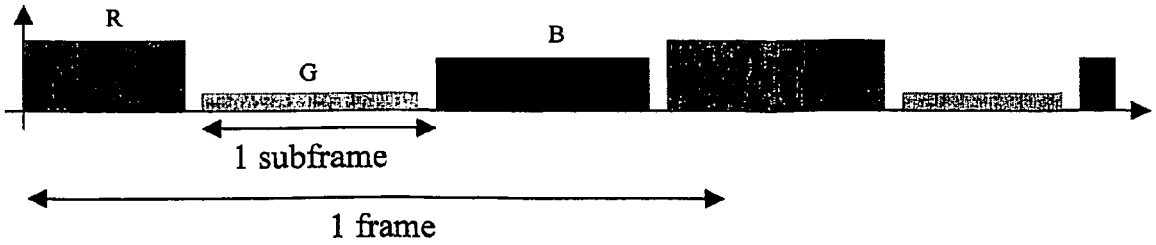
FIG. 8 is a graph representing the light output in function of time in case there is only 1 light valve.

A schematic representation of a 1-valve optical engine is shown in FIG. 7. Alternately the red R, green G and blue B component of the visual spectrum of the light, as shown in FIG. 8 is directed to each pixel of the LCOS matrix (and images). This is called 'temporal multiplexing'. Two systems can be used: pulsed light source or scrolling colour.

In case of 'pulsed light source', the light source is pulsed and sends out alternately the red R, green G and blue B component of the visible spectrum of the light. Possible light sources are LEDs, lasers or conventional light sources provided with an optical system with fast shutters (e.g. LC shutters). All pixels are illuminated with the same colour of light at the same time.

In case of 'scrolling colour', moving colour bands are imaged on the LCOS matrix by means of a suitable optical system. Such optical systems may be a colour wheel 17 for example, as shown in FIG. 7, or a rotating prism (not represented). Each pixel receives subsequently the red R, green G and blue B component of the visible spectrum of the light. However, at each moment, a part of the pixels are illuminated with the red light, while another part of the pixels are illuminated with the green light and still another part of the pixels are illuminated with the blue light. Typically all pixels on one row are illuminated with the same colour of light.

Figure 25:
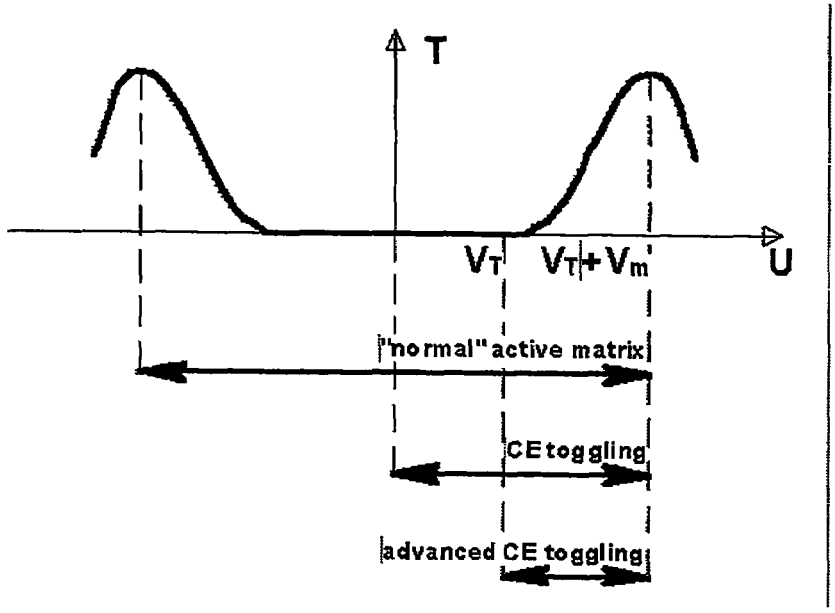
FIG. 25 illustrates voltage ranges need to drive a liquid crystal pixel without and with counter-electrode toggling.

FIG. 25 illustrates the voltage ranges that are needed to drive a liquid crystal pixel in an AM when no counter-electrode (CE) toggling is used, when CE toggling is used, and when advanced CE toggling is used according to an embodiment of the present invention. Advanced CE toggling will be explained below.

The right-hand side of FIG. 25 is the traditional transmission curve (electro-optical response) of a typical liquid crystal cell. The threshold voltage $V_T$ and the modulation voltage $V_m$ are represented. In order to prevent a permanent DC component, which would destroy an LC pixel, such pixel is normally driven in AC mode, meaning that the polarity of the applied voltage is alternated on a regular basis (usually this happens once per frame time). For the pixel transistor itself, the row and the column driver, this means that they have to be able to cope with at least the voltage span from $-(V_T+V_m)$ to $(V_T+V_m)$; this means a total voltage span of (more than) $2(V_T+V_m)$.

Figure 9:
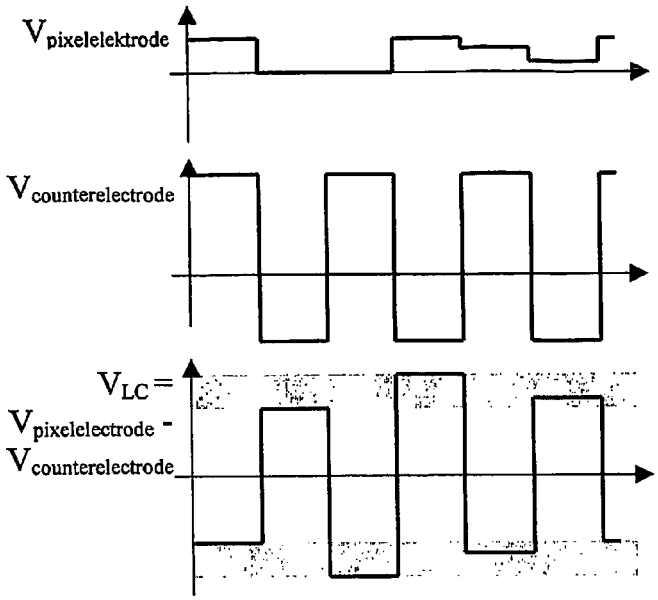
FIG. 9 is a graph of the counter-electrode modulation in function of time, and the effect this has on the resulting pixel voltage.
Figure 26:
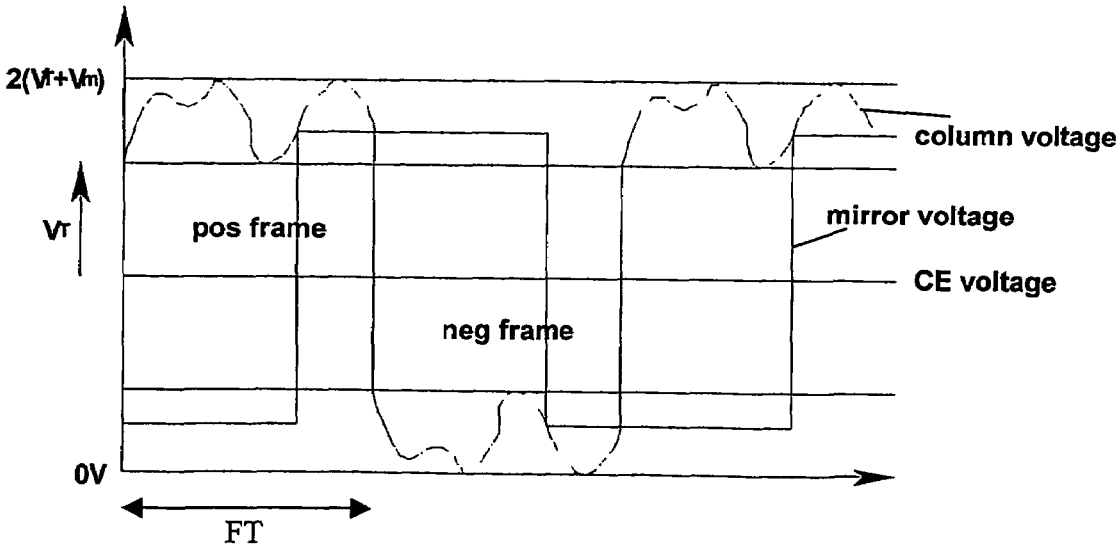
FIG. 26 is a graph of column driver output and mirror voltage in a "normal" frame inversion scheme.

FIG. 26 shows a typical waveform at one of the outputs of the column driver. In order to preserve DC compensation, the polarity of the signals is changed every frame time FT, leading to positive and negative frames. The column driver has to handle $2(V_T+V_m)$, while the voltage of the counter-electrode (CE voltage) is kept at $V_T+V_m$. Looking at the voltage on the mirror (Al electrode) of a single pixel in that column, something like the mirror voltage in FIG. 26 is observed. The voltage on the pixel mirror electrode is kept constant for a whole frame time and changes when the corresponding line of the active matrix is selected. The actual pixel voltage is $V_{mirror}-V_{CE}$ and is a perfectly symmetrical square wave, as also illustrated in FIG. 9.

Using counter-electrode toggling (CE toggling), i.e. applying a changing voltage to the counter-electrode, the required voltages that the column driver has to produce can be reduced to $(V_T+V_m)$. Using advanced counter-electrode toggling according to an embodiment of the present invention, the required voltage range can further be reduced to the useful voltage swing $V_m$.

Figure 27:
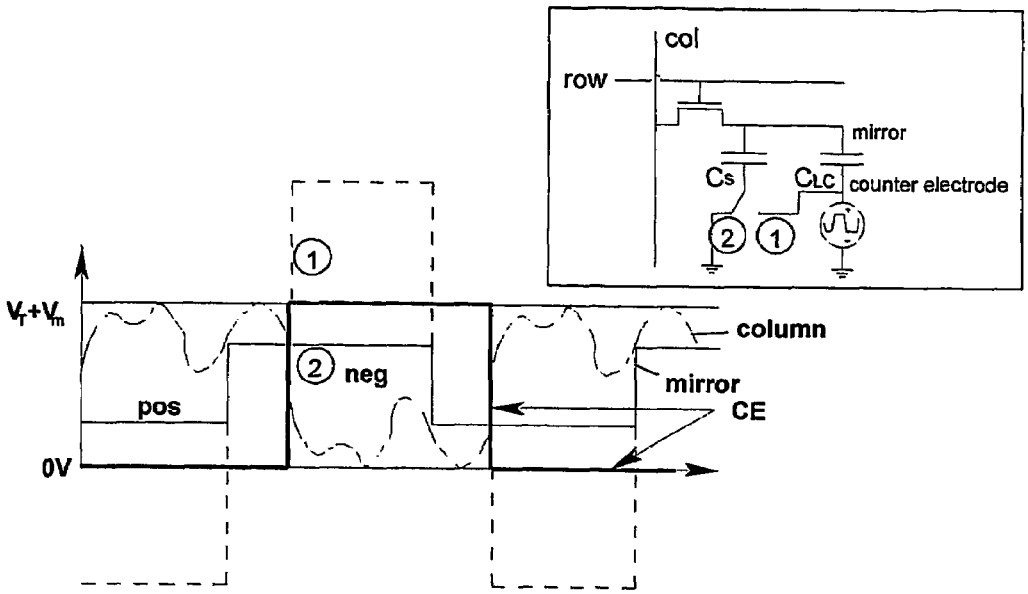
FIG. 27 illustrates CE toggling with and without toggling of an in-pixel memory device.

In FIG. 27, it is shown that the column driver output voltage is limited between 0V and $V_T+V_m$, while the counter-electrode voltage CE "toggles" from 0V to $V_T+V_m$ between positive and negative frames. Again, the resulting mirror voltage is shown.

However, there are 2 different cases, depending on the way an in-pixel storage capacitor $C_s$ is wired (see inset of FIG. 27).

If an in-pixel storage capacitor Cs is normally grounded (situation 2 in FIG. 27), the mirror signal represented in FIG. 27 is obtained, assuming that $C_s >> C_{LC}$. Now all the voltages stay limited between 0V and $V_T+V_m$, which is compatible with LCOS, but the actual pixel voltage $(V_{mirror}-V_{CE})$ is only correct for a fraction of the frame time. This fraction is smaller for the pixels that are selected later (bottom rows) than for the pixels that are selected earlier (top rows).

If the "ground" of $C_s$ is connected to the CE voltage (situation 1 in FIG. 27), then the dashed line is obtained: the mirror voltage follows the discontinuities in the CE voltage and the effective pixel voltage $(V_{mirror}-V_{CE})$ stays correct all the time. It is to be noted, however, that the maximum voltage span that the pixel transistor must withstand, is $3\times(V_T+V_m)$. The same is true for the row driver that provides the gate voltage for the pixel transistor. In other words, the voltage requirements for the column driver have been effectively decreased, but the voltage requirements for the pixel transistors and for the row drivers have increased. This scheme is often used in TFT displays with external drivers, because the column drivers are the most complicated driver ICs and it is beneficial to reduce their voltage requirements at the expense of the voltage requirements for the (much simpler) row drivers and the pixel transistors. In LCOS, all drivers and pixel transistors are made in the same technology and have the same voltage limitations. Therefore, this scheme is unusable in LCOS.

Figure 28:
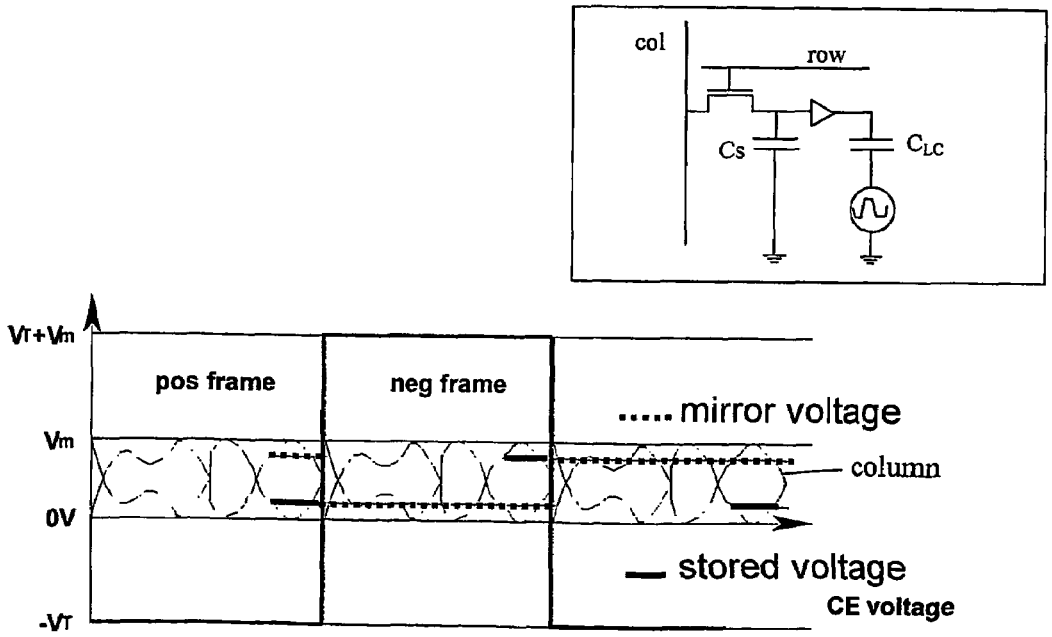
FIG. 28 illustrates advanced CE toggling according to an embodiment of the present invention.

FIG. 28 illustrates the case of advanced CE toggling according to an embodiment of the present invention. The CE is not only used to compensate for the polarity inversions, but also for absorbing the threshold voltage $V_T$ of the liquid crystal, or at least a part thereof. This part may be 25% or more, preferably 50% or more, more preferred 75% or more, still more preferred 80% or more. Absorbing a part of the threshold voltage $V_T$ of the liquid crystal may lead to a serious reduction of the required voltages, and may lead to better achievements with regard to switching speed. A reason is that switching to exactly the threshold voltage is slow in most liquid crystal modes, i.e. the optical response is slow, while switching to a voltage below the threshold voltage usually takes place in a faster way.

In the example represented in FIG. 28, the counter-electrode CE toggles between a voltage $-V_T$ and a voltage $V_T+V_m$. The aim is to limit the voltages on the LCOS pixel electrode or mirror electrode to the interval $[0, V_m]$.

A schematic circuit diagram for implementing enhanced CE toggling is illustrated in the inset in FIG. 28. One electrode of the storage capacitor $C_s$ is connected to the ground. A buffering element is provided, suitable for copying a voltage on the storage capacitor $C_s$ to the pixel capacitor $C_{LC}$ when commanded to do so, such as for example a sample-and-hold buffer which e.g. samples synchronously with the toggling of the CE voltage. In the circuit diagram illustrated in the inset of FIG. 28, the pixel circuit represented is a simple DRAM circuit. However, other suitable circuits with in-pixel memory, such as for example double DRAM or bucket brigade pixel circuits as described below, may be used with this enhanced CE toggling circuit.

When a certain row of the active matrix is selected, the new column data $V_d$ is written onto the storage capacitor $C_s$, and upon command this data value is copied to the pixel mirror by the buffering element. At the same time of copying the column data onto the pixel mirror (or immediately thereafter), the complementary data $V_m-V_d$ is stored in the memory $C_s$. Whenever CE toggling occurs, the voltage in the memory is copied to the mirror. During the negative frame, the complementary data are written to the pixel mirror and the regular data are written to the memory. In this way, the actual pixel voltage ($V_{mirror}-V_{CE}$) is always correct, and all voltages (column driver, pixel transistor and row driver) have been reduced.

This relaxes the voltage requirements for the LCOS pixel electrode, or allows the use of higher voltage LC materials.

It can also make it feasible to use voltage overdrive to speed up the pixel response time.

What the advanced CE toggling does is to use the available CMOS voltage interval as good as possible. The available CMOS voltage interval ranges between 0V and $V_{max}$, $V_{max}$ being the maximum voltage available, which maximum voltage is technology dependent, for example $V_{max}$ equals 3V or 5V. The available CMOS voltage interval is used as good as possible by moving it to the modulation part of the electro-optical characteristic of the liquid crystal (see FIG. 25). In the example given above, it is moved to an interval ranging between the threshold voltage and the sum of the threshold voltage and the modulation voltage $[V_T, V_T+V_m]$. If the modulation voltage is smaller than the maximum voltage ($V_m<V_{max}$), then the voltage surplus $V_{max}-V_m$ can be divided symmetrically below and above the interval $[V_T, V_T+V_m]$. In this case, CE toggling may be carried out between $-[V_T-(V_{max}-V_m)/2]$ and $[V_T+V_m+(V_{max}-V_m)/2]$. The voltages 'on chip' are limited to a voltage between 0V and $V_{max}$. It is to be noted that, if $V_m=V_{max}$, then the same results as above are obtained.

An example is given hereinafter:

$V_{max}=5V$
$V_T=2V$
$V_m=4V$

This means that $V_T+V_m=6V$, which is larger than $V_{max}$, therefore conventional CE toggling cannot be carried out. However, $V_m<V_{max}$, thus advanced CE toggling according to the present invention can still be carried out. The difference between the maximum voltage and the modulation voltage can be, but does not need to be, divided below and above the required voltage range. This means that CE toggling may be carried out between −1.5V and +6.5V. The voltages on the column driver will range between 0V and 5V, and the liquid crystal will see a voltage between 1.5V and 6.5V.

It is to be noted that, in order to keep the intensity on a pixel constant over 2 subsequent frames, data and complementary data need to be placed on that pixel (as the counter-electrode switches). The sum of the voltage corresponding herewith ($V_{data}+V_{complementary_data}$) is a constant depending on the modulation voltage and on the choice of the two counter-electrode voltages between which is switched.

Two configurations can be distinguished: row-at-a-time and frame-at-a-time.

The conventional method of refreshing a display is the row-at-a-time refresh method in which the refresh is carried out on a line-by-line basis while the AM is not illuminated. Once all lines have been written, and thus all pixel electrodes have adopted the right voltage and the LC of each pixel has reached a steady state, the light source becomes active again. A few moments later, the light source is de-activated again, the counter-electrode polarity switches and the display is written again on a line-by-line basis, this time with data corresponding with the new polarity of the counter-electrode. At least the time needed to write the data in the display can not be used to illuminate the display. This is only useful for 3-valve systems with small duty cycles and with pulsed light sources with small duty cycles. Row-at-a-time does not work with scrolling colour if combined with counter-electrode switching or toggling.

In frame-at-a-time, maximum duty cycles are allowed for the light source. This can only be reached if at any moment (thus also immediately after switching of the counter-electrode), the absolute value of the pixel voltage equals the desired RMS voltage. As the counter-electrode is common for all pixels, this requires a frame-at-a-time solution. Frame-at-a-time implies the presence of a memory element in each pixel. The minimum memory element functions are WRITE (analog data is written to the pixel memory element, while the voltage on the pixel electrode remains unchanged) and TRANSFER (the analog data from the memory element is transferred to the pixel electrode; generally, but not necessary, this function destroys the data in the memory cell).

In case of scrolling colour combined with counter-electrode switching, an information update of the pixel electrodes of the whole screen takes place, but also for every line this has to be done when writing a new colour.

Figure 10:
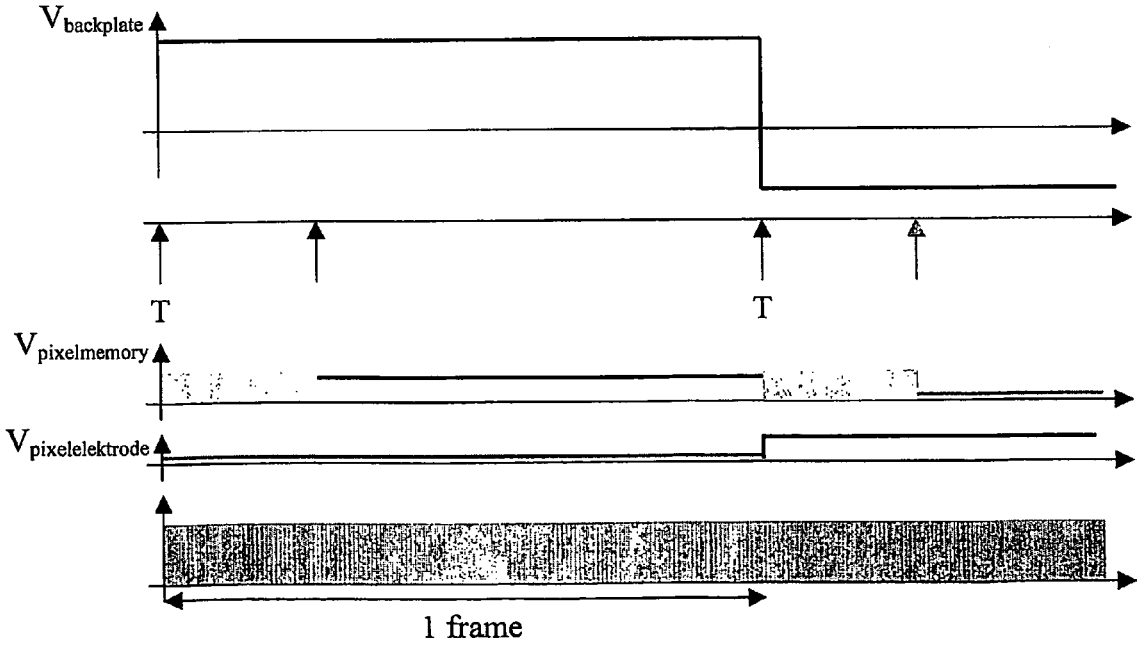
FIG. 10 is a timing diagram of one pixel or row in a counter-electrode switching scheme in a 3-valve optical system.

For a 3-valve optical system, the information on the pixel electrode is maintained while writing the new data during a WRITE step (FIG. 10). When the bottom line is written, the counter-electrode switches polarity while all pixel electrodes receive (by the TRANSFER step T) their new voltages. The timing diagram of FIG. 10 is thus only valid for all pixels of one row.

Figure 11:
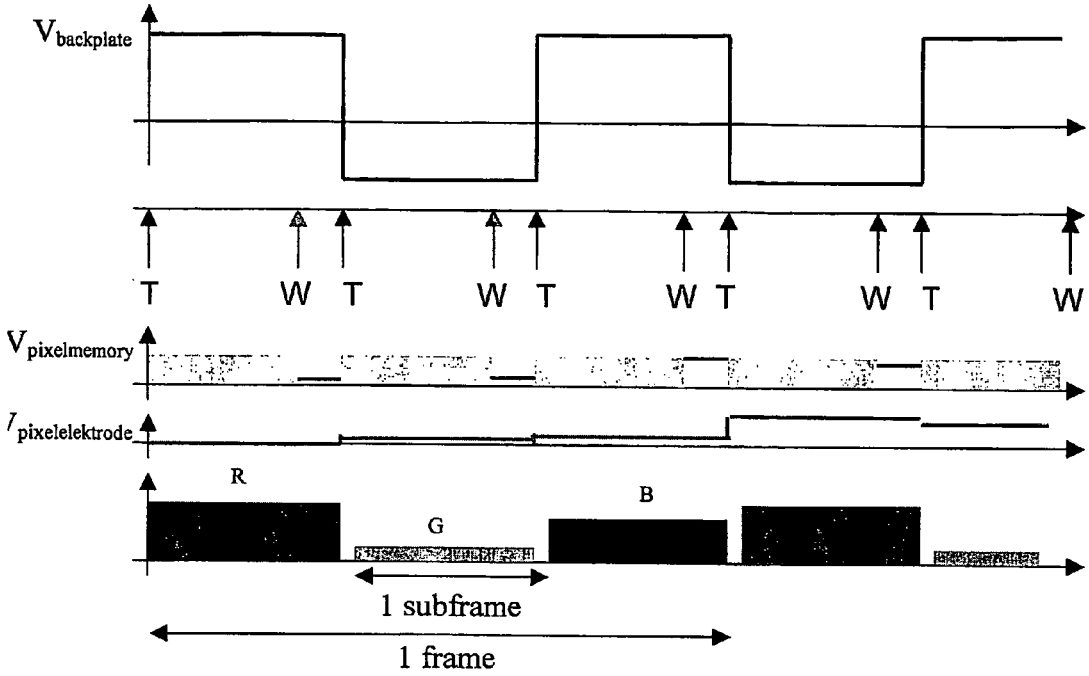
FIG. 11 is a timing diagram of one pixel or row in a counter-electrode switching scheme in a 1-valve optical system with pulsed light source.

For a 1-valve optical system with pulsed light source, the information on the pixel electrode is maintained while new data (a new colour and a new counter-electrode polarity are expected) is written in the memory element during a WRITE step (FIG. 11). When the bottom line has been written, the light source is activated and the counter-electrode changes polarity while all pixel electrodes reach their new voltages (by the TRANSFER) step. Only thereafter, when the LC of every pixel has reached its final value, the light source with a new colour is activated. The timing diagram of FIG. 11 is thus only valid for all pixels of one row. In FIG. 11 the polarity of the counter-electrode changes after every subframe; however, it can also change for example after every frame, or as another example, after every two subframes.

For a 1-valve optical system with scrolling colour, 3 horizontal colour bands move from top to bottom (or inversely) over the display screen. When a certain colour band has just passed a row completely, the pixel electrode voltages of that row are adapted to the voltages for the new colour, which has been written in the meantime. This is done by a WRITE+TRANSFER step. Immediately thereafter, the complementary data is written in the memory cells of these pixels by means of a WRITE step (FIG. 12). The switching of the counter-electrode can take place at any moment, provided that no two TRANSFER steps follow each other, or, with other words, a TRANSFER step needs to be preceded by a WRITE step. This means that the counter-electrode can switch maximum once per subframe (this is what is illustrated in FIG. 12). Less than once per subframe is also possible, e.g. once per frame.

Figure 13:
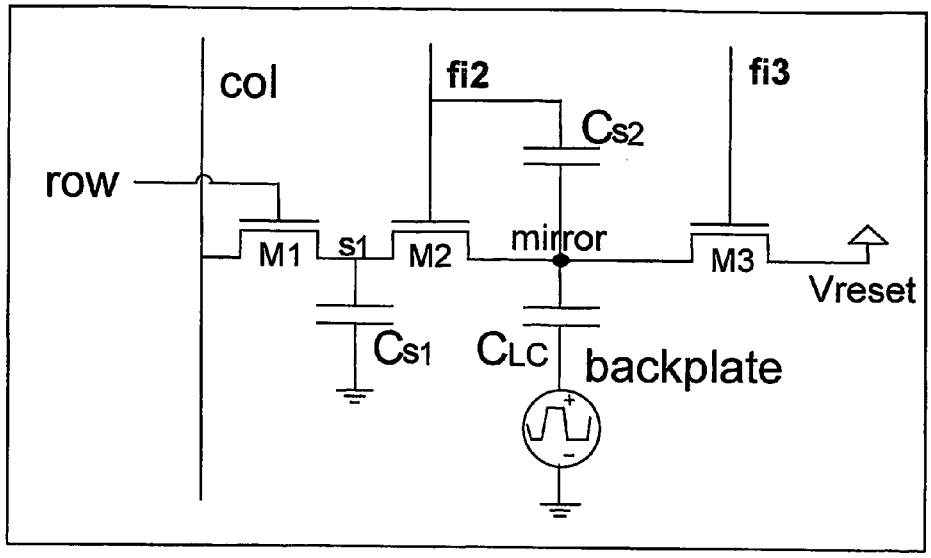
FIG. 13 shows a pixel architecture according to a first embodiment of the present invention.

A pixel architecture according to a first embodiment of the present invention is shown in FIG. 13. It comprises three separately driven switch elements in series, namely transistors M1, M2, M3 and uses the counter-electrode switching technique. The main advantage of counter-electrode switching is the reduction in processing cost: the low voltage range enables the use of cheaper IC technologies. This circuit overcomes one of the big disadvantages of counter-electrode switching applied to the basic single pixel single storage architecture, namely, the illumination duty cycle is maximised, thereby improving the overall light throughput of the display system. Also the number of components is low which allows formation of the control circuitry in a small pixel area, i.e. less than 15×15=225 micron$^2$, more preferably equal to or less than 12×12=144 micron$^2$, and most preferably, equal to or less than 7×7=49 micron$^2$. There are two memory elements, namely storage capacitors $C_{S1}$ and $C_{S2}$. Storage capacitor $C_{S1}$ has a first electrode connected between the first switch element M1 and the second switch element M2, and a second electrode connected to a fixed voltage level, such as ground for example. Storage capacitor $C_{S2}$ is floating, which imposes an extra mask or step for the IC processing (CAPA-implant or double poly technology). It has a first electrode connected between the second switch element M2 and the third switch element M3, and a second electrode connected to a driving electrode of the second switch element M2. Storage capacitor $C_{S2}$ holds the image data during a frame, while the other storage capacitor $C_{S1}$ is being updated with the data of the next frame. After the counter-electrode is switched, the new image data is transferred from $C_{S1}$ to $C_{S2}$ along a charge transfer path. A characteristic of the circuit is that it implements an 'analog shift register': the signal transfer from $C_{S1}$ to $C_{S2}$ occurs without a loss in signal amplitude. The loss-free signal transfer along the charge transfer path requires two more transistors which complicates somewhat the driving of the active matrix (two more signals (fi2 and fi3) per row which are supplied by the timing circuit, not shown).

Figure 14:
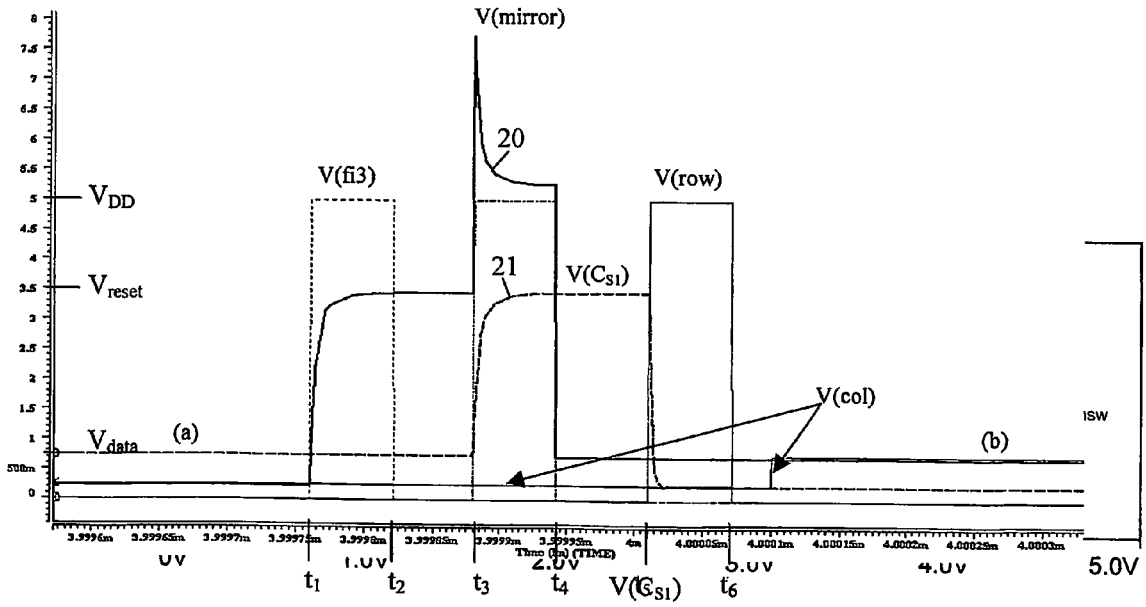
FIG. 14 shows a simulation of the charge transfer in the embodiment of FIG. 12 when the counter-electrode is not being switched.

The sequence of operations performed when displaying data in an LCOS pixel controlled by a pixel architecture as shown in FIG. 13, is as described below. FIG. 14 shows a simulation of the charge transfer (the counter-electrode is not being switched in this example). In the following all drive signals are provided by a timing circuit (not shown).

During a WRITE step, the data voltage is transferred from the column col to the first memory element, namely storage capacitor $C_{S1}$. This requires the activation of the first switch element, namely transistor M1 through gate signal 'row'. This operation corresponds to the storing of the next frame contents.

Then follows a TRANSFER step. First, at $t_1$, comes the activation of another switch element, namely transistor M3, as preparation for the actual lossless transfer. At that moment, the voltage on the gate of the second switch element, transistor M2, is at low potential, e.g. 0 V. The storage capacitor $C_{S2}$ has a voltage dropped across it which is determined by $V_{reset}$. Once storage capacitor $C_{S2}$ has been reset by transistor M3 (at $t_2$, the gate of M3 goes back to ground potential), activation of another switch element at $t_3$, namely transistor M2, discharges $C_{S2}$ by as much as transistor M2 allows before this switch element shuts off. When switching on M2 at $t_3$, fi2 goes high, e.g. to $V_{DD}$, and $V_{mirror}$ immediately follows due to the charge on $C_{S2}$. The mirror voltage peaks up to e.g. 8V for a short while (~20 ns); the height of this peak can be reduced by increasing the rise time of V(fi2): in the present example of FIG. 14 it was set to 1 ns, other examples with 10 ns rise times show peak voltages just above 6.5V. This is because $C_{S2}$ is given time to discharge while M2's gate is still rising.

Part of the charge on $C_{S2}$ flows towards $C_{S1}$ along the charge transfer path, as can be seen from parts 20 and 21 of the graph of FIG. 14. The voltage on $C_{S1}$ cannot exceed fi2$-V_{th}$, assuming all conditions are met for a positive charge transfer towards $C_{S1}$. Switching off transistor M2 at $t_4$, makes the mirror voltage $V_{mirror}$ become equal to the voltage previously stored on storage capacitor $C_{S1}$. At this moment, the TRANSFER step has taken place, as the value which previously had been written on storage capacitor $C_{S1}$ is now put on the pixel electrode.

In a next step, at $t_5$, switch element transistor M1 is activated by applying a high voltage, e.g. $V_{DD}$, to "row". Data voltage is transferred from the column "col" to the first memory element, namely storage capacitor $C_{S1}$, and thus data for the next frame is stored during this WRITE step. At $t_6$ the switch element transistor M1 is deactivated again, and a TRANSFER step as explained above can be carried out.

The circuit operation can be summarised as follows: the memory element, namely storage capacitor $C_{S2}$ is pre-set to a reference voltage $V_{ref,S2}$ and switch element M2 makes storage capacitor $C_{S2}$ charge up the further memory element, namely storage capacitor $C_{S1}$ by an amount limited to exactly $V_{ref,S2}-V_{data}$. The resulting voltage across storage capacitor $C_{S2}$ is then $V_{ref,S2}$ [preset]$-(V_{ref,S2}-V_{data})$ [amount gone to $C_{S1}$]$=V_{data}$. It is to be noted that $V_{data}$ equals the modulation portion of the LC driving voltage. The threshold portion $V_{thlc}$ is obtained by switching of the counter-electrode.

Figure 15:
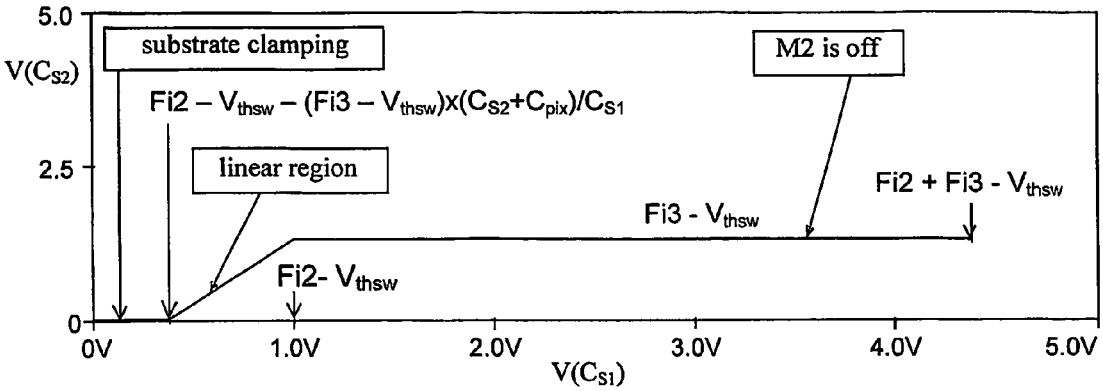
FIG. 15 shows the relation between the voltage across storage capacitor $C_{S1}$ and storage capacitor $C_{S2}$ of FIG. 12.

The relative sizes of the storage capacitors $C_{S1}$ and $C_{S2}$ should be chosen correctly in conjunction with the voltage levels Vrow, fi2, fi3 and Vreset. To illustrate the operating limits, the relation between the voltage across $C_{S1}$ and $C_{S2}$ is shown in FIG. 15. Three operating regions can be noted: one of clamping by the M2 terminal substrate diode on the 'mirror' node, a second linear region where the data voltage is amplified by a factor $(C_{S2}+C_{LC})/C_{S1}$ and a third saturation region where M2 can never get into conduction.

Preferably, a terminal diode of transistor M2 at the side of the pixel electrode (mirror) prohibits negative voltages. $V_{mirror}$ can become negative e.g. when $C_{S1}$ is very large compared to $C_{S2}$ and when $C_{S1}$ is at a low potential: turning on M2 will then completely discharge $C_{S2}$ to a low voltage level. Turning off $C_{S2}$ would 'push' the mirror voltage below zero, if the terminal diode wasn't there. Preferably the values of $C_{S1}$ and of $C_{S2}$ are equal, and $C_{LC}$ is much smaller than $C_{S2}$.

The linear region is characterised by the amplification of $V_{data}$ by $(C_{S2}+C_{LC})/C_{S1}$.

Counter-electrode switching is done before the charge transfer to zero out an error voltage resulting from the finite ratio between $C_{S2}$ and $C_{LC}$. In addition, this eliminates a dependency on the exact ratio of storage capacitance $C_{S2}$ and pixel capacitance $C_{LC}$. However, once the counter-electrode has been switched, it must still be possible for transistor M3 to reset $C_{S2}$: $V_{data,max}+V_{pp,counter\text{-}electrode}\times C_{LC}/(C_{LC}+C_{S2})<=fi3-V_{th}$. In other words, fi3 must be large enough to reset $C_{S2}$ even after switching of the counter-electrode.

Figure 16:
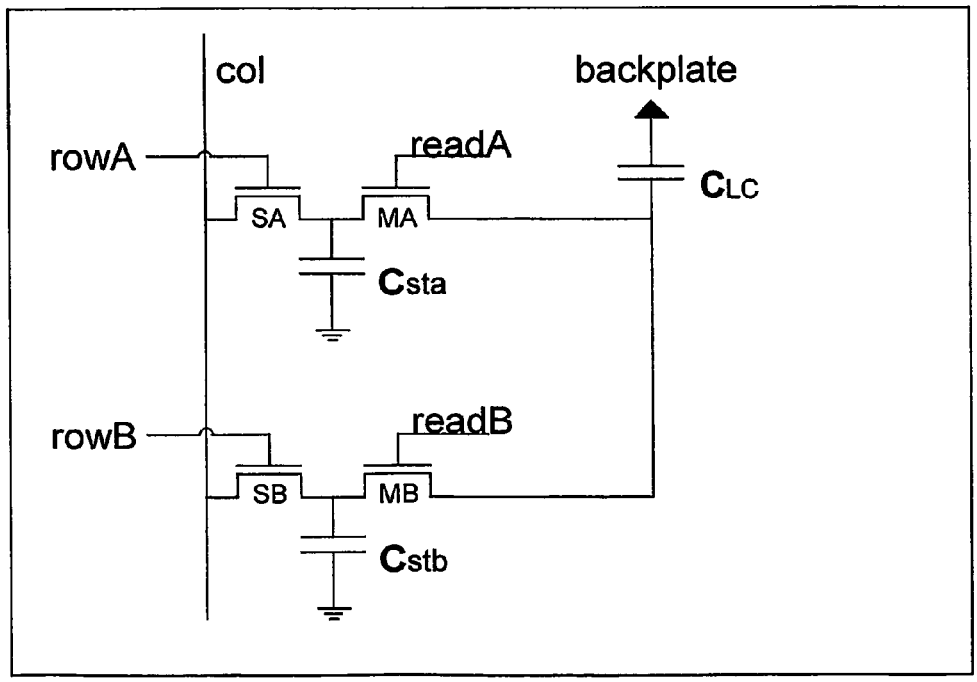
FIG. 16 shows a pixel architecture according to a second embodiment of the present invention.

A further embodiment of the present invention is shown in FIG. 16. This circuit provides every pixel with a second or 'shadow' memory element, namely a storage capacitor that stores the voltage for a next frame with e.g. opposite electrical polarity, and with a second or shadow charge transfer path. While the 'shadow' memory element is being refreshed, the 'active' memory element drives the complete pixel matrix. Together with the counter-electrode voltage the active memory element connected to the pixel array (AM) creates a pattern of electrical fields of one polarity across the liquid crystal. The two electrodes (counter-electrode and pixel electrode) form a capacitor $C_{LC}$; the capacitance is a function of the LC layer and often this capacitor is non-linear. Switching the counter-electrode to another voltage causes the electrical field to change and switching to an adequate voltage can even cause the electrical field to change polarity. Switching of the counter-electrode voltage is intended to result in an alternating electrical field across the LC. The pattern of electrical fields is changed, and the resulting image is no longer correct. Therefore, the shadow memory element stores the voltages needed to obtain the correct electric fields (opposite electrical polarity) after switching the counter-electrode voltage. The fact that counter-electrode switching can be applied leads to a significant reduction in the required voltage range of the pixel electrode. The presence of the shadow memory element avoids scanning of the complete AM after counter-electrode switching. As a result the switching can be done within a relatively short time window. The shadow memory element results in maximising the time window during which the pixel voltages are correct, or in other words: results in a maximum illumination duty cycle.

Although two memory elements per pixel and two charge transfer paths per pixel are shown, the present invention is not limited thereto. The switch elements, namely transistors SA, SB, MA, MB can be of either n- or p-type; however, n-types usually have higher mobility parameters, so they are faster and preferred. Floating p-types may be advantageous because the body effect is minimised; however, there is always a loss of one threshold voltage Vt with a single transistor switch circuit and the amplitude of the column voltage is always limited to the maximum gate voltage minus Vt. The memory elements, namely storage capacitors Csta, Cstb can be non-floating, this simplifies the requirements for or the cost of the IC technology (e.g. a double poly technology is not needed).

The readA and readB signals, applied at the gates of two switch elements, namely, transistors MA and MB respectively, are basically each others' inverse. They connect the pixel electrode on turns with storage capacitor Csta and with storage capacitor Cstb. The two series of storage capacitors form a double memory element structure, which will be called double DRAM or $D^2$RAM. DRAM_a is a memory element which stores the voltage levels for one frame (e.g. of one polarity), while DRAM_b is a memory element being updated with the voltage data for the next frame or subframe (e.g. of opposite polarity or of other colour). In practice the two signals readA and readB should not be active simultaneously to eliminate a non-desirable charge transfer between the two DRAMs.

When the readA signal is high or active, the memory element DRAM_a drives the pixel matrix (the data of storage capacitor Csta is put on the corresponding pixel element $C_{LC}$) and updating of the storage capacitor Csta is disabled ('rowA' signal is inactive). While the memory element DRAM_a is driving the corresponding pixel element $C_{LC}$, the contents of the DRAM_b matrix is being updated.

During a WRITE+TRANSFER step, readA is high or active and readB is low or inactive. Also rowB is low or inactive. ReadA is high or active until Csta has reached the desired voltage. Alternatively, during the WRITE+TRANSFER step, readB is high or active and readB is low or inactive. Also rowB is low or inactive. ReadA is high or active until Csta has reached the desired voltage.

During a WRITE step, if readA was high or active, then rowB is brought to a high or active status, until Cstb has reached the desired voltage, given by the data value on the data line col. If readB was high or active, then rowA is brought to a high or active status, until Csta has reached the desired voltage, given by the data value on the data line col.

During a subsequent TRANSFER step, if readA is in a high or active state, the readA is brought to low or inactive. ReadB is brought to high/active, until a next TRANSFER or WRITE+TRANSFER step. If readB was in a high or active state, the readB is brought to low or inactive, and readA is brought to high/active, until a next TRANSFER or WRITE+TRANSFER step.

Only 4 low voltage switch elements, namely transistors SA, MA, SB, MB and two low voltage memory elements, namely storage capacitors Csta, Cstb are needed for the circuit of FIG. 16. The storage capacitors Csta, Cstb can be implemented as gate capacitors. The capacitance density of these capacitors is higher compared to double poly, medium to high voltage storage capacitors. With two transistors in series, the same bulk effect is present as with the classical DRAM architecture, because the data voltage never exceeds Vmax(gate)−Vt. The pixel switch could be implemented with CMOS switches, but this doubles the number of transistors and requires the presence of biased wells and their clearing area—this solution costs more than double the area.

The idea of two parallel circuits driving/underneath the pixel matrix, can be extended to provide more parallelism. The idea can be of interest for static AMs or purely digital AMs (e.g. for driving Ferro-electric Liquid Crystals (FLCs)).

The combination of different single panel colour schemes and counter-electrode switching can be used with the above mentioned AM embodiments as long as the refresh speed is high enough. The degree of increase in refresh speed depends on the minimum speed required to mitigate colour break-up effects and on the colour scheme used. The smallest increase is with frame sequential colour schemes.

With the classic DRAM-like AM, the light output with frame sequential colour is reduced by the duty cycle of the panel illumination and reduced by the >60% loss of white light in the colour filter. However, embodiments of the present invention described above as a $D^2$RAM architecture allow a quasi-simultaneous update of all pixel voltages. This means the duty cycle in a frame sequential colour scheme can be very close to 100%. The frame rate needs to be at least 3× the frame rate in a triple panel set-up. Higher rates can be desirable to reduce colour break-up artefacts.

The scrolling colour (colour wheel) and rotating prism schemes (known from Philips) are improvements over the classic DRAM frame sequential colour scheme, because the light throughput is larger. The colour wheel can be combined with a colour recuperation technique that avoids the 60% loss. The rotating prism does not use a colour filter, but a 'colour separator' so that less or no light power is wasted.

Applying counter-electrode inversion requires both DRAMs' to be updated. This way counter-electrode inversion can be done at any moment. However, this requires double the frame rate: either a double column pixel layout must be foreseen or a column driver with two times as much parallelism.

Figure 17:
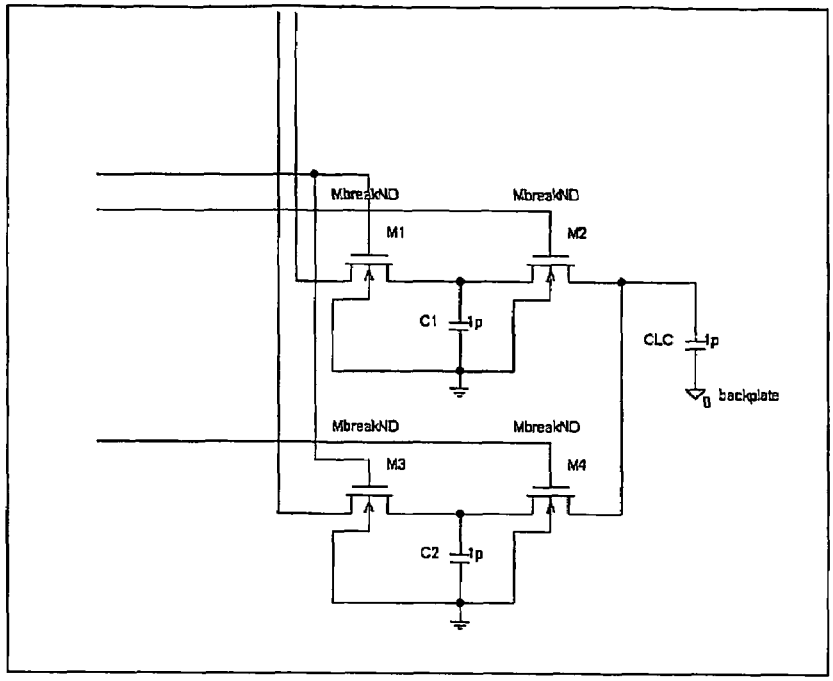
FIG. 17 shows a pixel architecture according a further embodiment of the present invention, which comprises an enhanced data supply to the second embodiment.

According to a further embodiment, which is an amendment to the circuit of FIG. 16, data and complementary data are stored simultaneously on memory elements, namely storage capacitors C1 and C2. A diagrammatic representation of a circuit corresponding to this embodiment is given in FIG. 17. This embodiment allows the number of row signals to be decreased to one for every row. An advantage thereof is that for some control schemes, e.g. for scrolling colour with counter-electrode switching, the sequence WRITE+TRANSFER followed by WRITE is replaced by one simultaneous action, more particularly switch elements M1 and M3 are simultaneously open and either the switch element M2 is open and switch element M4 is closed, or the inverse. The TRANSFER action then comprises the following: if M2 was open, then M2 is closed and thereafter M4 is opened; if M4 was open, then M4 is closed and thereafter M2 is opened. The replacement of 2 actions (WRITE+TRANSFER followed by WRITE) by 1 action has an important impact on the design of the column driver. Because data and complementary data are always put on the memory elements, namely storage capacitors simultaneously, the data stream (bandwidth) in the column driver can be reduced to one half with respect to the conventional method, by using differential analog electronics (opamp) with about the same complexity.

Figure 18:
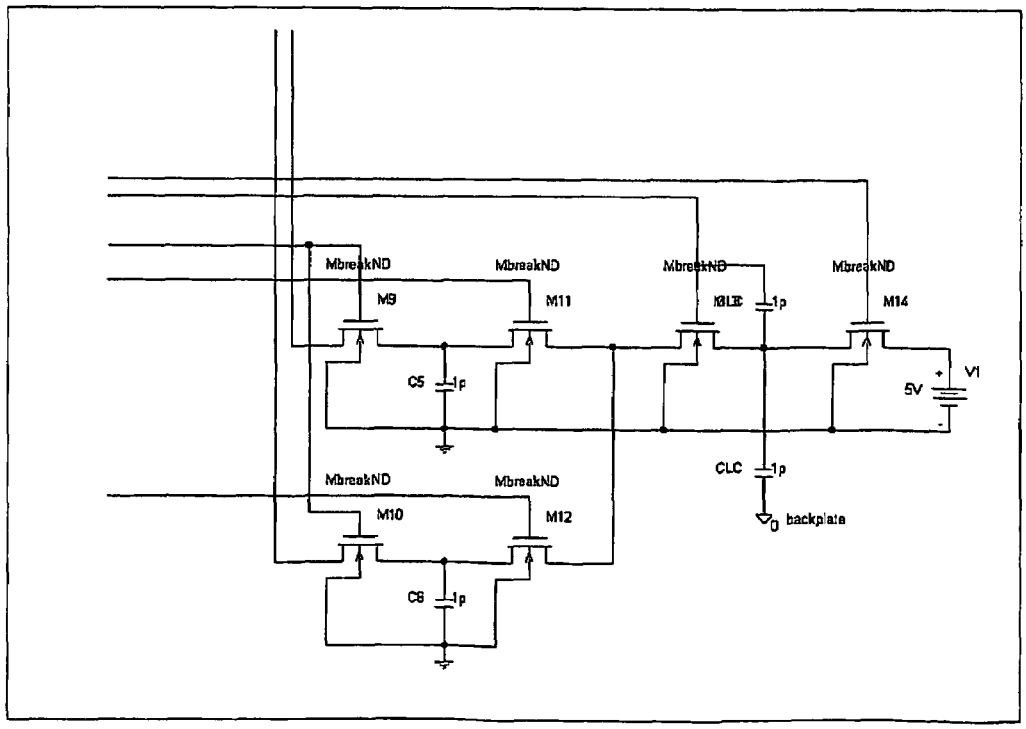
FIG. 18 shows a pixel architecture according to yet a further embodiment of the present invention, which comprises an enhanced data supply to the first embodiment.

According to yet a further embodiment, the circuit of FIG. 13 can be amended in an analogous way. The result is shown in FIG. 18. Here also, the data and complementary data are put simultaneously on the memory elements, namely storage capacitors C5, C6 respectively. An advantage of this embodiment is that with certain control schemes, e.g. scrolling colour with counter-electrode switching, the sequence WRITE+TRANSFER followed by WRITE, in which the column driver is active twice, is replaced by the sequence WRITE and TRANSFER. The WRITE step then consists of opening two switch elements, namely transistor M9 and transistor M10, while all other switch elements (transistors in the figure) are kept closed. This stores data on the memory elements, namely storage capacitors C5 and C6 respectively. The TRANSFER step then consists of, if the data on storage transistor C5 has to be transferred, opening switch element M11, while switch element M12 is kept closed; and if the data on storage transistor C6 has to be transferred, opening M12 while M11 is kept closed. Thereafter the method as explained above with regard to FIG. 13 is followed. Replacing the sequence of 2 actions by 1 action has the same impact on the design of the column driver as in the previous embodiment.

Double DRAM involves analog driving of the LC pixel. It is known that transitions from one intermediate grey scale to another can be very slow in LC pixels, while-transitions from completely white to completely black (and vice versa) are usually faster. Therefore, the according to a further embodiment of the present invention, binary addressing (black/white) with pulse width modulation (PWM) is applied to any of the above circuits to provide grey levels, thus providing optimised pixel response speed.

The use of pulse width modulation has the advantage that it alleviates the choice of LC materials and modes: only the black and white behaviour must be according to specs. The intermediate behaviour is not relevant, for example when using PWM it is allowed that the LC pixel exhibits hysteresis.

Figure 19:
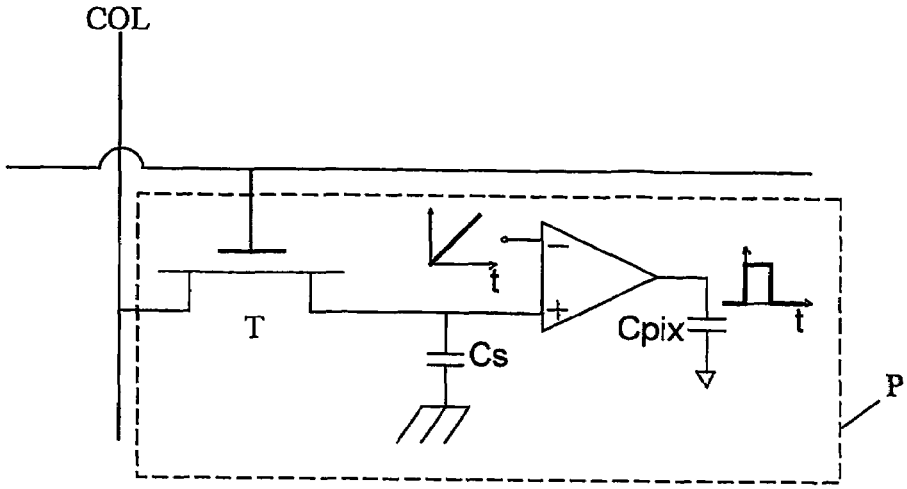
FIG. 19 illustrates the general principle of PWM in a pixel according to an embodiment of the present invention.

The general principle of a PWM pixel architecture is represented in FIG. 19. The pixel P comprises a switching element, such as switching transistor T, for allowing an electric charge present on a column line COL to be stored on a storage capacitor Cs, a PWM circuit for pulse width modulating the electric charge stored on the storage capacitor Cs, so as to obtain a pulsed signal of which the width of the pulses corresponds to the amount of electric charge stored on the storage capacitor Cs. This pulsed signal is applied to the pixel electrode of the LC device. The wider a pulse to be applied to the pixel electrode, the longer the pixel is in a first state, for example a bright state or a dark state, and the brighter or darker the pixel appears.

The PWM circuit as in FIG. 19 comprises a comparator device for comparing a signal corresponding to the electronic charge stored on the storage capacitor Cs with a ramp signal, which ramp signal may be externally generated. As long as the ramp signal, e.g. a ramp voltage, is lower than the signal corresponding to the stored electric charge, e.g. the voltage over the storage capacitor Cs, the supply voltage of the comparator device is applied to the pixel electrode. As soon as the ramp signal exceeds the signal corresponding to the stored electric charge, the voltage on the pixel electrode becomes 0 Volts. This results in a pulsed voltage signal on the pixel electrode, with a pulse width that depends linearly on the stored electric charge. By changing the shape of the ramp voltage, the relation between pulse width and stored voltage can be made non-linear, if desired.

Because the liquid crystal is essentially switched between extreme states (maximum voltage or 0 volts), its response time will be lower than with analog voltage modulation driving for obtaining grey values.

A good comparator can only be made using a lot of transistors. Because of the space limitations underneath a pixel, according to the present invention non-perfect comparator circuits are used, which still provide results which are good enough for the application (PWM of signals).

In the above diagram illustrating the principles of PWM, the analog memory cell, e.g. a double DRAM or bucket brigade cell, is replaced for simplicity reasons by a simple DRAM, consisting of one transistor and one storage capacitor Cs.

Figure 20A:
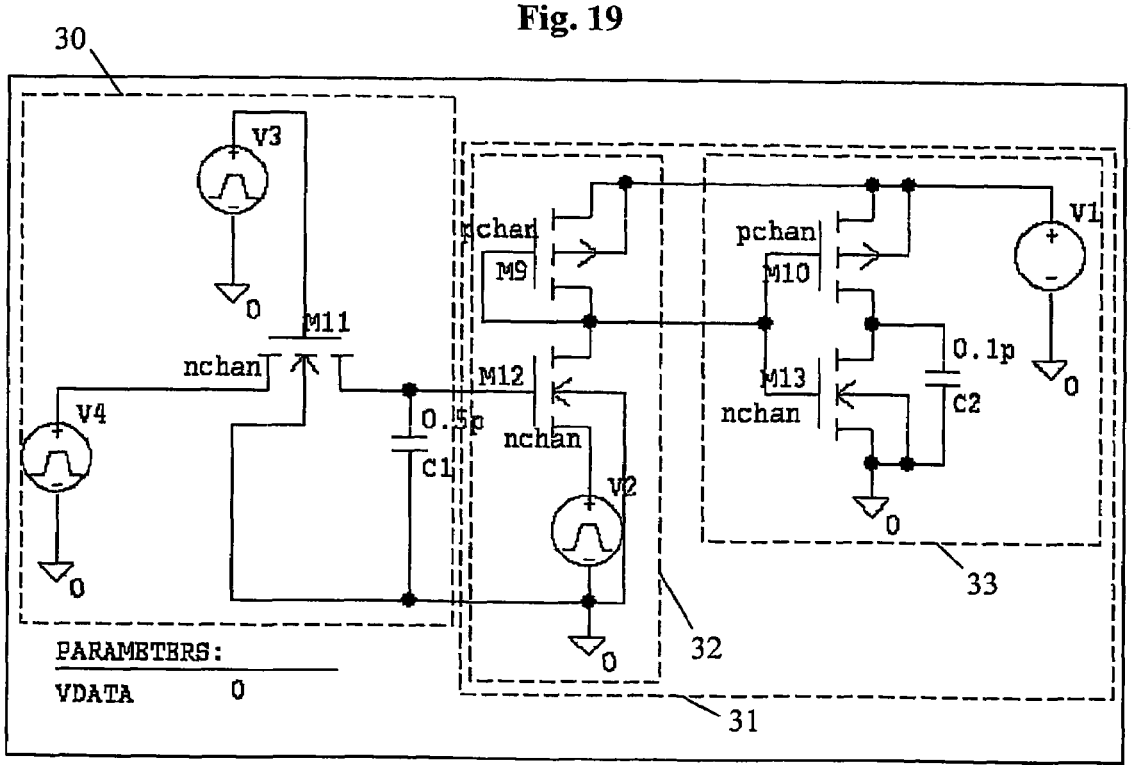
FIG. 20(*a*) shows a first arrangement of a DRAM circuit in which PWM is implemented according to an embodiment of the present invention.
Figure 20B:
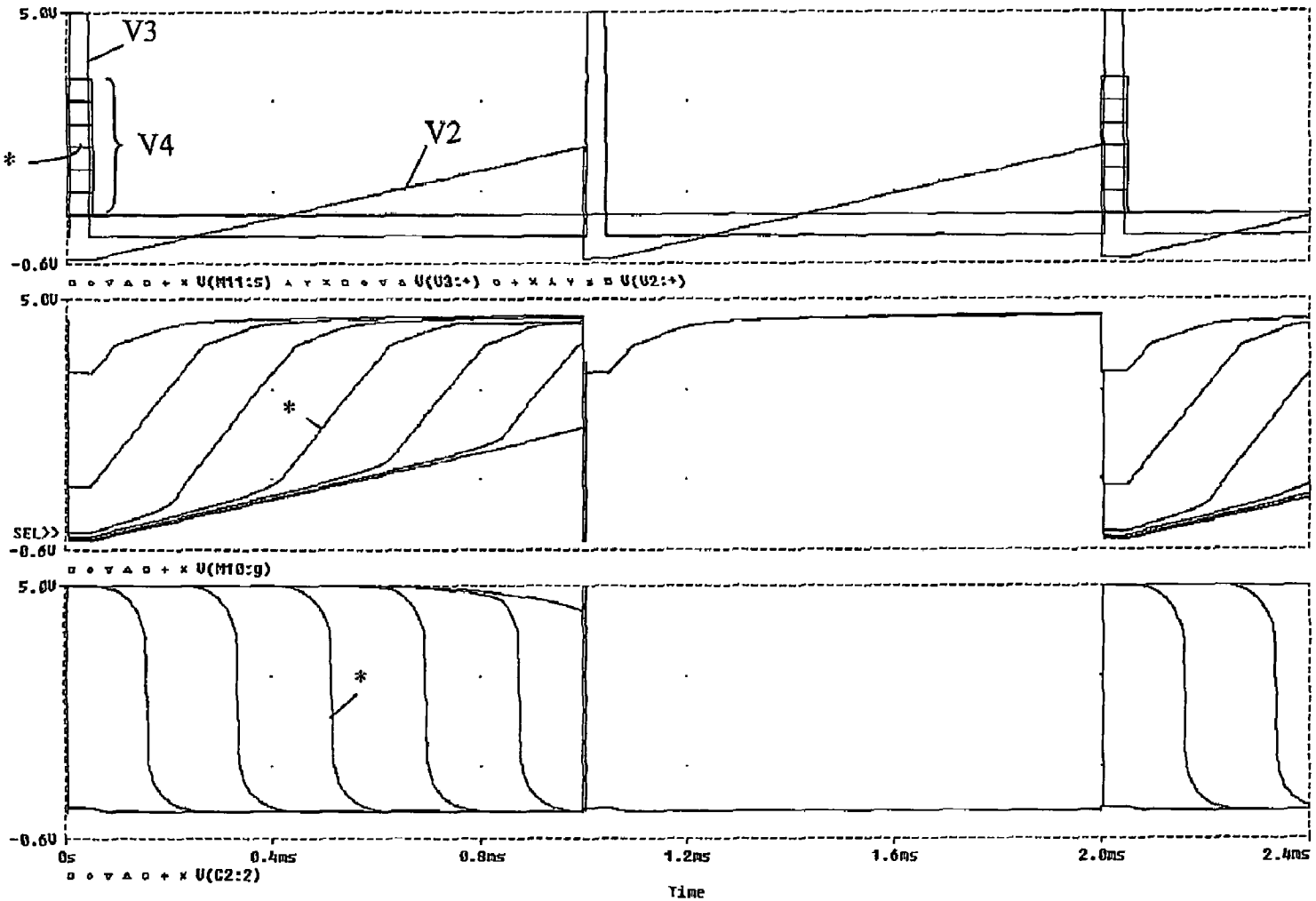

FIG. 20(*a*) illustrates an embodiment of a DRAM cell 30 in which a first embodiment of a PWM circuit 31 is implemented. As mentioned before, the DRAM cell 30 can be replaced by any analog memory cell, such as for example a DDRAM cell or bucket brigade cell. The PWM circuit 31 comprises a switching circuit 32 and a wave-shaping circuit 33.

In the embodiment represented in FIG. 20(*a*), the switching circuit 32 consists of a resistive load inverter coupled between a sloped low voltage provided by source V2, and a constant supply voltage provided by source V1. The resistive load inverter comprises a pull-up resistor, formed by a depletion load or transistor M9, and a switching transistor M12 to pull down the voltage coupled in series.

The wave-shaping circuit 33 consists of a complementary inverter for improving the output signal. It comprises one NMOS transistor M13 and one PMOS transistor M10 coupled in series between ground and supply voltage V1. The gates of both transistors M10, M13 are coupled to each other.

The circuit functions as follows. An electric charge is stored on the storage capacitor C1. A voltage corresponding to this electric charge is compared to a sloping voltage V2 applied at the low voltage connection of the resistive load inverter of the switching circuit 32. As long as the voltage on the storage capacitor C1 exceeds the sum of the sloping voltage V2 at the low voltage connection of the resistive load inverter and the threshold voltage of the transistor M12, the transistor M12 is conductive, and the voltage at the node between the gate of transistor M10 and the gate of transistor M13 has a first, "high" level, which is substantially equal to the supply voltage VI. As soon as the sum of the sloping voltage V2 with the threshold voltage of transistor M12 exceeds the voltage corresponding to the electric charge stored on the capacitor C1, transistor M12 is switched off, and is not conductive anymore. The voltage at the node between the gate of transistor M10 and the gate of transistor M13 has a second, "low" level, substantially equal to zero.

If the voltage at the node between the gate of transistor M10 and the gate of transistor M13 has the first, "high" level, then NMOS transistor M13 is in an ON-state, and PMOS transistor M10 is in an OFF-state. The load capacitor C2 discharges to the ground. If the voltage at the node between the gate of transistor M10 and the gate of transistor M13 has the second, "low" level, then PMOS transistor M10 is in an ON-state, and NMOS transistor M13 is in an OFF-state. The LC capacitor C2 of the pixel element charges to the supply level V1.

The above shows that the pixel capacitance is driven by a clean pulse wave switched between a first and a second stable states, having levels zero and V1 for example. The width of the pulses depends on the amount of electric charge stored on the capacitor C1.

Simulation results for the circuit of FIG. 20(*a*) are shown in FIG. 20(*b*). the graph comprises three parts: a top part illustrating applied signals, a middle part illustrating the output of resistive load inverter for the different input data signals, and a bottom part illustrating the pixel electrode voltage, i.e. the output of the complementary inverter, for the different data signals. The applied signals comprise the ramp signal V2, the line select signal V3 and the video data (analog column data) V4. The video data as shown in the left frame of the top part of the graph comprises a plurality of data signals ranging from 0.5 to 3.5 Volts in steps of 0.5 Volts. In the second frame, the data signal is always 0.5 Volts. The line select signal V3 is 5 Volts high and the ramp signal V2 ramps from −0.5 Volts to 2 Volts. It can be seen that, e.g. for an input data signal V4 of 2 Volts, graphs corresponding to this signal being indicated with * in FIG. 20(*b*), the output of the resistive load inverter 32 is not a nice pulse, but the output of the complementary inverter already better approaches a real pulse.

Figure 21A:
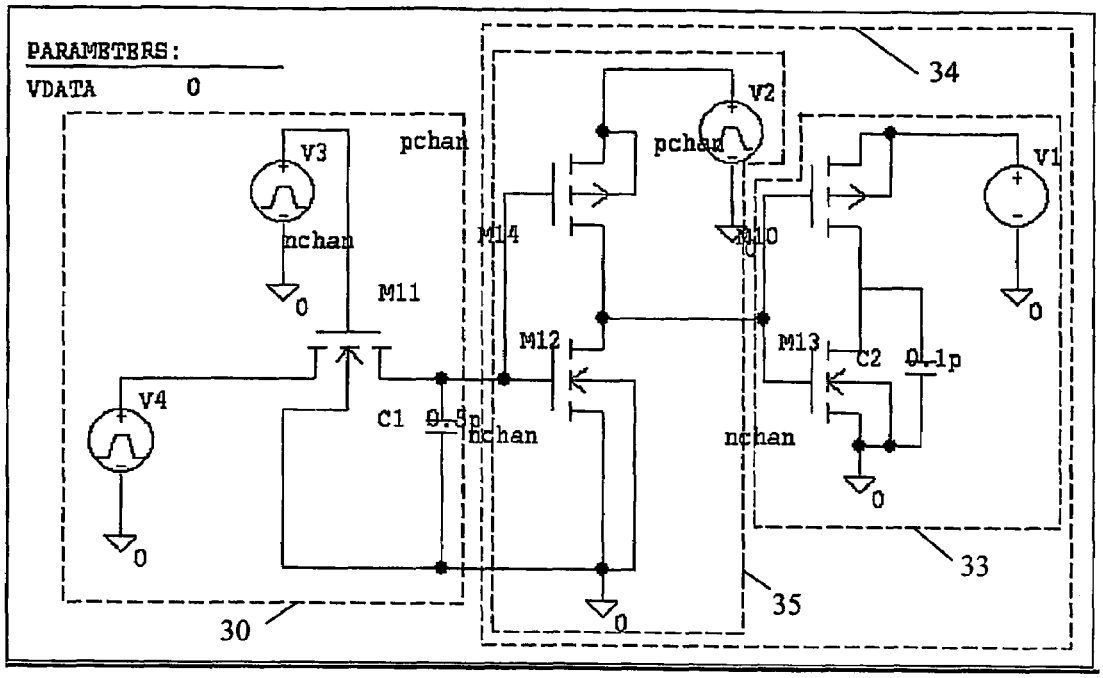
FIG. 21(*a*) shows a second arrangement of a DRAM circuit in which PWM is implemented according to an embodiment of the present invention.
Figure 21B:
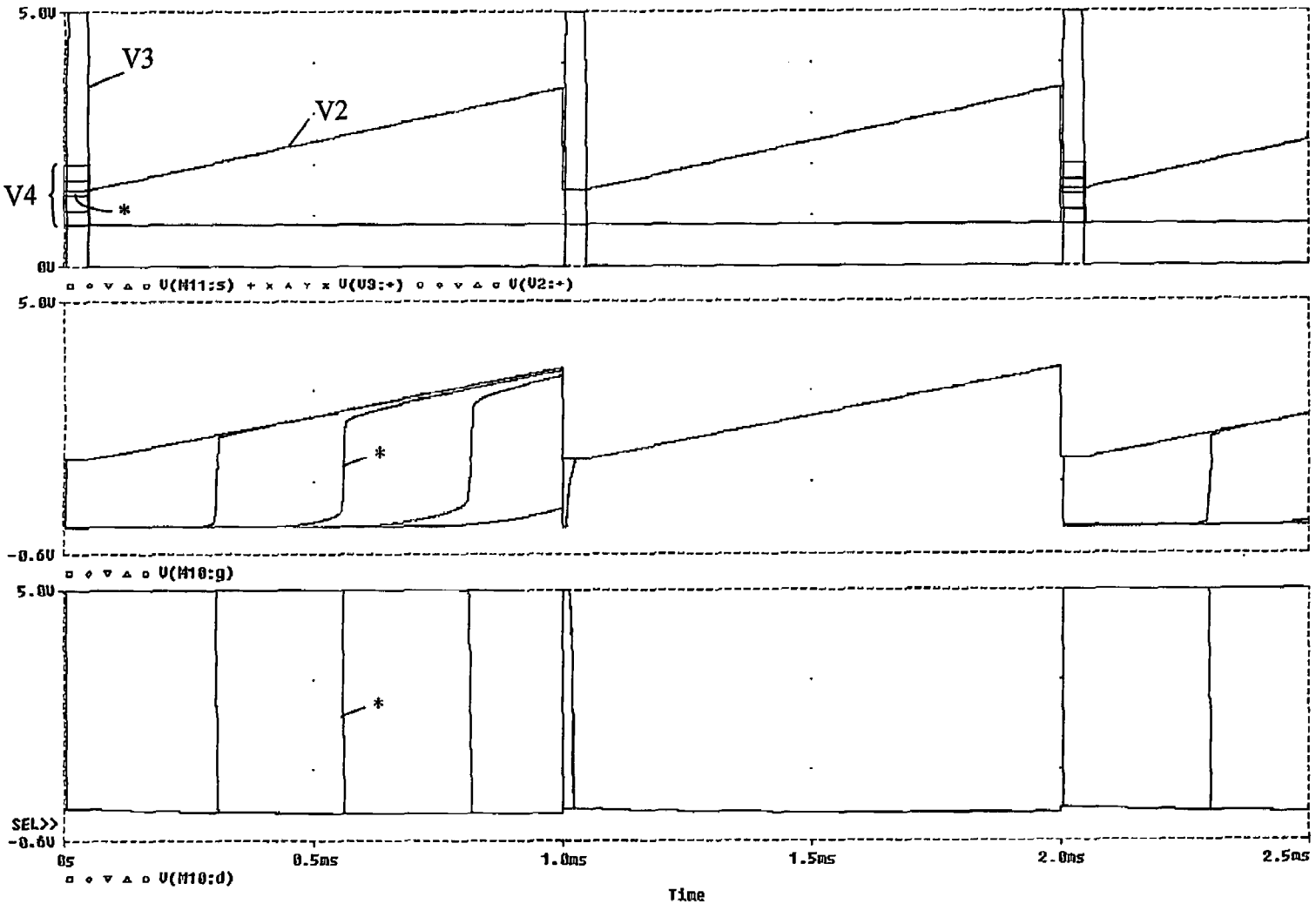

FIG. 21(*a*) illustrates an embodiment of a DRAM cell 30 in which a second embodiment of a PWM circuit 34 is implemented. As mentioned before, the DRAM cell 30 can be replaced by any analog memory cell, such as for example a DDRAM cell or bucket brigade cell. The PWM circuit 34 comprises a switching circuit 35 and a wave-shaping circuit 33.

The wave-shaping circuit 33 is as explained before with regard to FIG. 20(*a*).

In the embodiment represented in FIG. 21(*a*), the switching circuit 35 consists of a complementary inverter coupled between ground and a sloped supply voltage V2. The complementary inverter comprises an NMOS transistor M12 and a PMOS transistor M14 coupled in series between ground and supply voltage V2, whereby the gates of transistors M12 and M14 are connected together and to one of the electrodes of the storage capacitor C1.

The circuit functions as follows. An electric charge is stored on the storage capacitor C1. A voltage corresponding to this electric charge is compared to a sloping voltage V2 applied at the low voltage connection of the complementary inverter of the switching circuit 35. As long as the voltage on the storage capacitor C1 exceeds the sloping voltage V2, the transistor M14 is conductive. Current is conducted to the ground, and the voltage at the node at the gates of transistors M10 and M13 is at a first, "high" level, which is substantially equal to V2. As soon as the sloping voltage V2 exceeds the voltage corresponding to the electric charge stored on the capacitor C1, transistor M14 is switched off, and is not conductive anymore. The voltage at the node between the gate of transistor M10 and the gate of transistor M13 has a second, "low" level, substantially equal to zero.

If the voltage at the node between the gate of transistor M10 and the gate of transistor M13 has the first, "high" level, then NMOS transistor M13 is in an ON-state, and PMOS transistor M10 is in an OFF-state. The load capacitor C2 discharges to the ground. If the voltage at the node between the gate of transistor M10 and the gate of transistor M13 has the second, "low" level, then PMOS transistor M10 is in an ON-state, and NMOS transistor M13 is in an OFF-state. The LC capacitor C2 of the pixel element charges to the supply level V1.

The above shows that the pixel capacitance is driven by a clean pulse wave switching between a first and a second stable state, for example having levels zero and V1. The width of the pulses depends on the amount of electric charge stored on the storage capacitor C1.

Simulation results for the circuit of FIG. 21(*a*) are shown in FIG. 21(*b*). the graph comprises three parts: a top part illustrating applied signals, a middle part illustrating the output of resistive load inverter for the different input data signals, and a bottom part illustrating the pixel electrode voltage, i.e. the output of the complementary inverter, for the different data signals. The applied signals comprise the ramp signal V2, the line select signal V3 and the video data (analog column data) V4. The video data as shown in the left frame of the top part of the graph comprises a plurality of data signals ranging from 0.8 to 2 Volts in steps of 0.3 Volts. In the second frame, the data signal is always 0.8 Volts. The line select signal V3 is 5 Volts high; it can however be lower. The ramp signal V2 ramps from 1.5 Volts to 3.5 Volts. It can be seen that, e.g. for an input data signal V4 of 1.4 Volts, graphs corresponding to this signal being indicated with * in FIG. 21(*b*), the output of the resistive load inverter 35 is not a nice pulse, but the output of the complementary inverter almost perfectly approaches a real pulse.

Figure 22A:
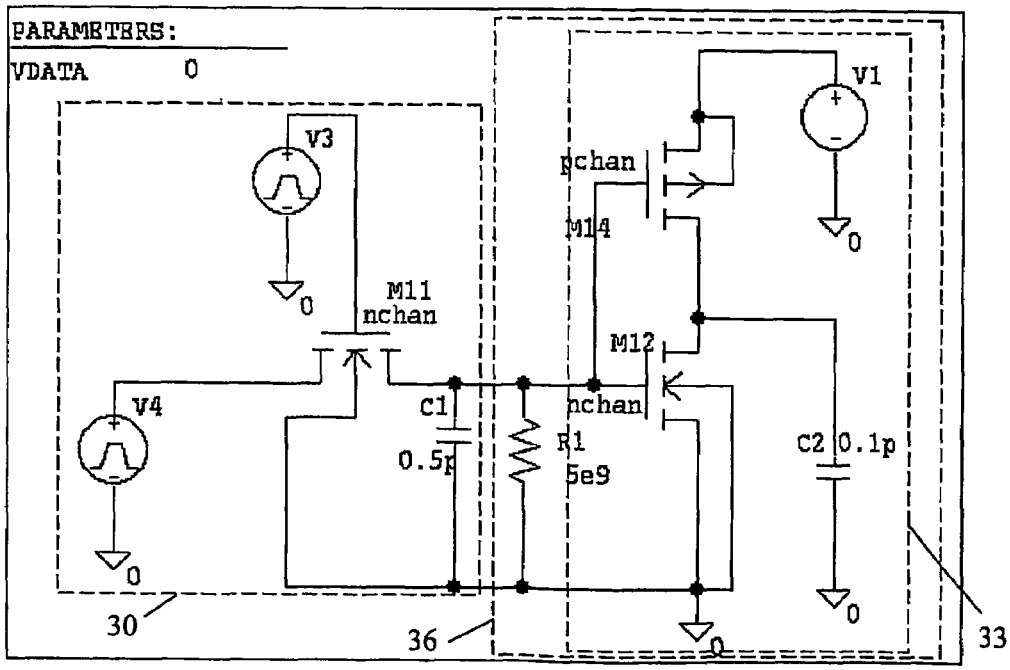
FIG. 22(*a*) shows a third arrangement of a DRAM circuit in which PWM is implemented according to an embodiment of the present invention.
Figure 22B:
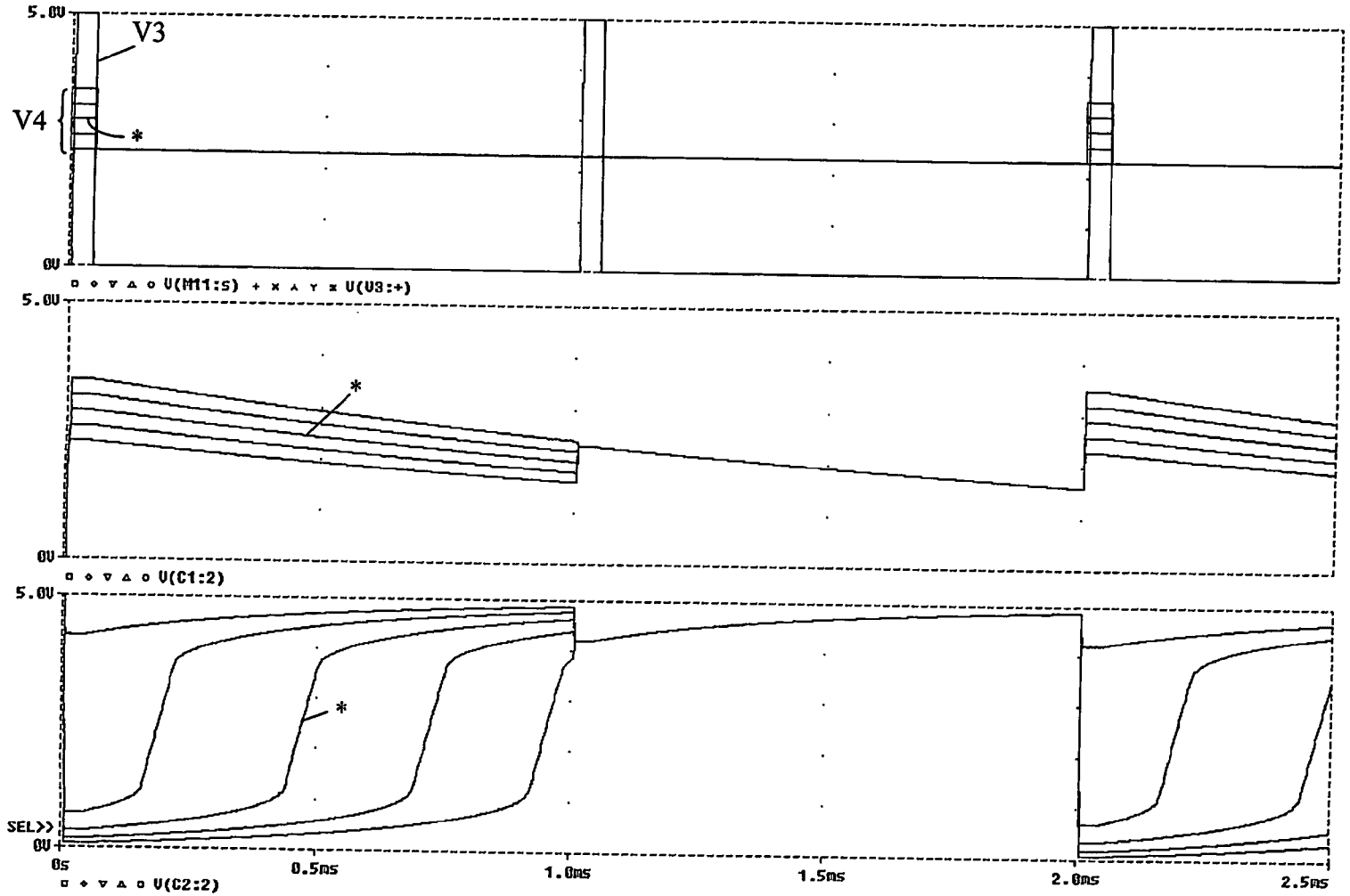

FIG. 22(*a*) illustrates an embodiment of a DRAM cell 30 in which a third embodiment of a PWM circuit 36 is implemented. As mentioned before, the DRAM cell 30 can be replaced by any analog memory cell, such as for example a DDRAM cell or bucket brigade cell. The PWM circuit 36 comprises a shunt resistor R1 and a wave-shaping circuit 33.

The wave-shaping circuit 33 is as explained before with regard to FIG. 20(*a*).

The circuit functions as follows. The input signal is stored on capacitor C1, and is connected to ground over a very high resistor R1. This way, an RC-circuit is formed. The capacitor C1 will discharge to ground with a time constant depending on the resistance value of the resistor R1 and the capacitance value of the storage capacitor C1. As long as the voltage corresponding to the electric charge stored on the storage capacitor C1 is high enough, transistor M12 will be conductive, and capacitor C2 will discharge to ground. When the electric charge on the storage capacitor C1 has decayed enough, i.e. the voltage corresponding to the remaining charge on the storage capacitor C1 drops below a certain value, transistor M12 is switched OFF, transistor M14 is switched ON, and LC capacitor C2 of the pixel element is charged to high voltage level V1.

The above shows that the pixel capacitance is driven by a pulse wave switching between a first and a second stable state, e.g. having levels zero and V1. The width of the pulses depends on the amount of electric charge stored on the storage capacitor C1 and on the time constant for discharging storage capacitor C1.

A sufficiently high resistor value is needed in order to obtain sufficient width of the pulses. For example, for a 360 Hz framerate, which corresponds to a frame time slightly less than 3 ms, the RC constant of the circuit should be in the order of 3 ms. If Cs is in the order of 20 fF, then R is in the order of $10^{11}$ ohm. This is a very attractive circuit as no ramp signal needs to be provided. The resistor can be emulated by a transistor with a pulsed gate signal with low duty ratio.

Simulation results for the circuit of FIG. 22(*a*) are shown in FIG. 22(*b*). the graph comprises three parts: a top part illustrating applied signals, a middle part illustrating the voltage on the storage capacitor C1 for the different input data signals, and a bottom part illustrating the pixel electrode voltage, i.e. the output of the complementary inverter, for the different data signals. The applied signals comprise the line select signal V3 and the video data (analog column data) V4. The video data V4 as shown in the left frame of the top part of the graph comprises a plurality of data signals ranging from 2.3 to 3.5 Volts in steps of 0.3 Volts. In the second frame, the data signal is always 2.3 Volts. The line select signal V3 is 5 Volts high. It can be seen that, e.g. for an input data signal V4 of 2.9 Volts, graphs corresponding to this signal being indicated with * in FIG. 22(*b*), the output of the complementary inverter 33 approaches a pulse signal. The pulse steepness of the output signal would get even better if complementary inverter 33 would be followed by a second inverter (not represented in the drawings).

Figure 23:
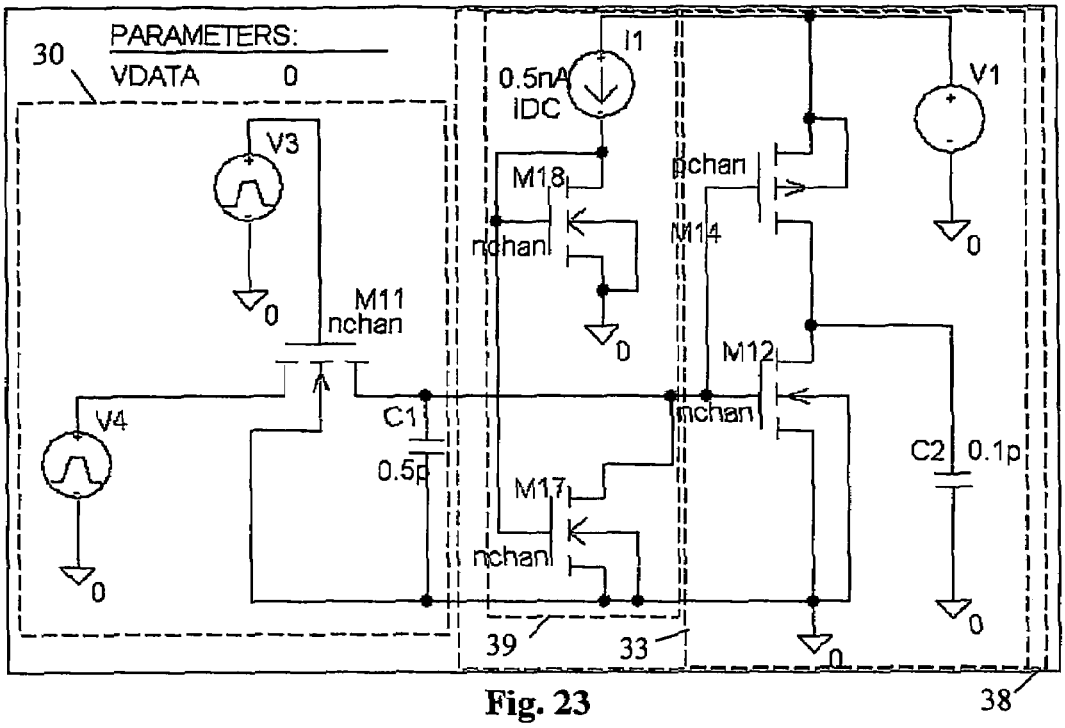
FIG. 23 shows a fourth arrangement of a DRAM circuit in which PWM is implemented according to an embodiment of the present invention.

FIG. 23 illustrates a further embodiment of the present invention. It comprises a DRAM cell 30 in which a third embodiment of a PWM circuit 38 is implemented. As mentioned before, the DRAM cell 30 can be replaced by any analog memory cell, such as for example a DDRAM cell or bucket brigade cell. The PWM circuit 38 comprises a wave-shaping circuit 33, which is as explained before with regard to FIG. 20. The embodiment of FIG. 23 is close to the embodiment of FIG. 22, but the resistor 37 has been replaced by a current mirror 39. This current mirror comprises a first transistor M17, a second transistor M18 and a current source I1. The first transistor M17 is located inside the pixel, the second transistor M18 and the current source I1 are common to all or a plurality of pixels of the display.

The circuit functions as follows. The transistors M18 and M17 act as a current mirror. A current source I1 that can be common for the whole array or a part of the whole array (e.g. a single row or column or a group of rows or columns) induces a fixed current into transistor M18. Because M17 has the same gate-source voltage as M18, the current flowing through M17 will be proportional to the current flowing through M18, and hence proportional to the current provided by the current source I1. The proportionality factor will be the ratio of the channel width-to-length ratio of transistor M17 to the channel width-to-length ratio of transistor M18. If the channel width-to-length ratio of M17 is much smaller than that of M18, a very small current can be induced in M17. Transistor M18 can be included in every pixel, or can be common to several pixels, a row or a column of pixels, or even the whole array. In all cases except the first, M18 will not consume a significant portion of the limited available silicon area inside every pixel.

The small current induced in M17 discharges the capacitor C1 with a constant rate. As long as the voltage corresponding to the electric charge stored on the storage capacitor C1 is high enough, transistor M12 will be conductive, and capacitor C2 will discharge to ground. When the electric charge on the storage capacitor C1 has decayed enough, i.e. the voltage corresponding to the remaining charge on the storage capacitor C1 drops below a certain value, transistor M12 is switched OFF, transistor M14 is switched ON, and LC capacitor C2 of the pixel element is charged to a high voltage level V1.

The above shows that the pixel capacitance C2 is driven by a pulse wave switching between a first and a second stable state, e.g. having levels zero and V1. The width of the pulses depends on the amount of electric charge initially stored on the storage capacitor C1, on the value of the current induced by current source I1 and on the ratio of the channel width-to-length ratios of transistors M17 and M18.

As with the previous embodiment, the pulse steepness of the output signal will get even better if complementary inverter 33 would be followed by a second inverter (not represented in the drawings).

Figure 24:
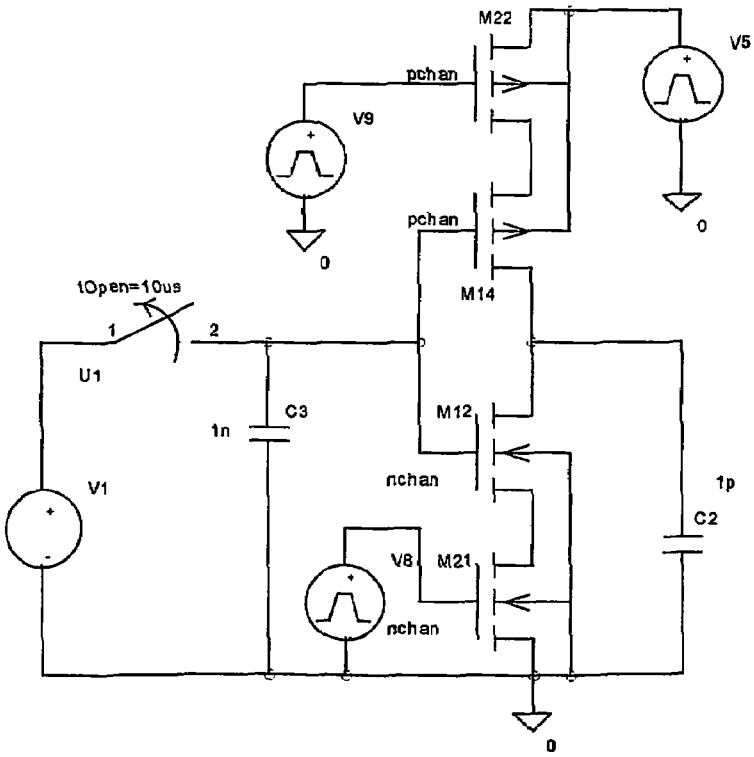
FIG. 24 shows a fifth arrangement of a PWM circuit in combination with a DDRAM circuit according to an embodiment of the present invention, the PWM circuit being provided with current limiting transistors.

According to a further embodiment, current limiting transistors M20, M21, M22 may be provided in any of the inverter structures. This is illustrated in FIG. 24, which shows one such inverter structure accompanied by current limiting transistors M21, M22. The inverter structure in this figure is used as a comparator, but the current limiting transistors can also be applied to a wave-shaping circuit. Strobe signals V8 and V9 are needed to drive the current limiting transistors M21, M22.

The functioning of this circuit is as follows: an analog voltage has been stored on the capacitor C3. This is depicted in FIG. 24 as a fixed voltage source V1 that is first connected to and subsequently disconnected from C3 by means of a switching element. The inverter comprising M12 and M14 acts as a comparator, comparing the voltage stored on C3 with the inverter's own commutation voltage. This commutation voltage changes over time, because the supply voltage of the inverter is a ramp signal, V5. The output of the inverter is a pulse signal that is low as long as the inverter commutation voltage is lower than the voltage stored on storage capacitor C3, and high as soon as the inverter commutation voltage exceeds the voltage stored on C3. So far, this is exactly the same as the comparator in the PWM embodiment shown in FIG. 21(*a*). The power consumption of such a comparator is very high, because the inverter is operating almost constantly close to its commutation point, where the current is at its maximum. In order to limit the power consumption, two current limiting transistors M21 and M22 are added that act as switches and that are switched off most of the time and activated simultaneously and periodically by strobe pulses with a small duty cycle. Every time the two current limiting transistors M21, M22 are conducting, the inverter functions as comparator and compares its commutation voltage with the voltage on storage capacitor C3. The output of the inverter varies accordingly. This output can for instance be used as the input of a second inverter acting as a wave shaping circuit (not represented in FIG. 24). Every time the current limiting transistors M21, M22 are off, the inverter is not working, but the output voltage stored on pixel capacitor C2 remains intact. Also, there is no current flowing through the inverter as long as M21 and M22 are switched off. This limits the power consumption of this inverter circuit.

The current-limiting transistors M21, M22 can also be incorporated in an inverter acting as a wave shaping circuit. In that case, the input voltage is the output of a comparator and the output voltage is connected to the pixel capacitance. Also, in that case, the supply voltage of the inverter is kept constant.

An advantage of the circuit with current limiting transistors M21, M22, as illustrated e.g. in FIG. 24, is that current consumption is greatly reduced.

An innovative aspect of the present invention is the low number of transistors required for the PWM circuits: less than 10 transistors are used. This is important in order to be able to put a PWM circuit in the limited space underneath every pixel.

While the invention has been shown and described with reference to preferred embodiments, it will be understood by those skilled in the art that various changes or modifications in form and detail may be made without departing from the scope and spirit of this invention.

The invention claimed is:

1. An array of pixels, each pixel comprising:

a pixel element, each pixel element comprising a first pixel electrode for individual control of the pixel element and a second pixel electrode, the second pixel electrode linking substantially all pixel elements in the array and being connected to a common counter-electrode, the first and second pixel electrode forming a first capacitor, the pixel element having a threshold voltage and a modulation voltage, a pixel refresh circuit, for transferring electric charge related to a pixel data value from a data input of the pixel to the first pixel electrode via a charge transfer path, a first memory element coupled to the pixel data input for storing electric charge related to the pixel data value, a first switch element located between the first memory element and the first pixel electrode for controlling charge transfer from the first memory element through the charge transfer path to the first pixel electrode, wherein the first switch element and the first memory element co-operate to transfer charge related to the pixel data value passively along the charge transfer path to the first capacitor and wherein the array further comprises means for applying a dynamically changing voltage to the common counter-electrode, the dynamically changing voltage changing between minus the threshold voltage of the pixel elements and the sum of the threshold voltage and the modulation voltage of the pixel elements so that the pixel data value is a signal comprised between zero volts and a data voltage value, the data voltage value being not smaller than the modulation voltage and smaller than the sum of the modulation voltage and the threshold voltage of any of the pixel elements.

2. An array according to claim 1, the first memory element having a first and a second electrode, the first electrode being coupled to the pixel data input, wherein the second electrode is coupled to ground.

3. An array according to claim 1, wherein each pixel further comprises conversion means for converting a stored amount of electric charge related to the pixel data value into a pulse with a pulse width for control of the pixel element, the pulse width corresponding to the stored amount of electric charge.

4. An array according to claim 3, wherein the conversion means comprises less than 10 transistors.

5. An array according to claim 3, wherein the conversion means comprises a comparator device.

6. An array according to claim 5, wherein the comparator device comprises at least one current limiting transistor.

7. An array according to claim 5, wherein the comparator device comprises a shunting resistive device and an inverter.

8. An array according to claim 7, wherein the shunting resistive device is a resistor.

9. An array according to claim 7, wherein the shunting resistive device is a transistor with a pulsed gate signal with a low duty ratio.

10. An array according to claim 7, wherein the shunting resistive device comprises a current mirror.

11. An array according to claim 5, wherein the comparator device comprises a switching circuit and a wave-shaping circuit.

12. An array according to claim 11, wherein the switching circuit comprises a resistive load inverter.

13. An array according to claim 11, wherein the wave-shaping circuit comprises at least one complementary inverter.

14. An array according to claim 12, wherein the resistive load inverter has a first and a second supply connection for connecting to lower supply voltage and a higher supply voltage respectively, wherein any of the first or second supply connection are connected to a sloping voltage source.

15. An array according to claim 1, wherein charge related to the pixel data value when stored in the first memory element generates a data voltage across the first memory element and the passive charge transfer applies substantially the same voltage as the data voltage on the first pixel electrode.

16. An array according to claim 1, the pixel refresh circuit further comprising: a mirroring circuit, for losslessly mirroring the pixel data value stored on the first memory element to the first pixel electrode of the pixel element.

17. An array according to claim 16, wherein the mirroring circuit comprises a first switch element having a first and a second data electrode and a control electrode, the first switch element being connected with its first data electrode to an electrode of the first memory element and with its second data electrode to the first pixel electrode, a second memory element for storing data values, the second memory element having a first and a second electrode, the second memory element being connected with its first electrode to the second data electrode of the first switch element, and with its second electrode to the control electrode of the first switch element, and resetting means, for resetting the data value stored in the second memory element.

18. An array according to claim 17, wherein the second memory element is a storage capacitor.

19. An array according to claim 1, furthermore comprising a second switch element between the first memory element and a data line for providing pixel data values.

20. An array according to claim 19, wherein the second switch element is a transistor.

21. An array according to claim 1, wherein the pixel element comprises a liquid crystal.

22. An array according to claim 21, wherein the pixel element comprises an LCOS element.

23. An array according to claim 1, wherein the first memory element(s) is (are) a storage capacitor(s).

24. An array according to claim 1, wherein the first switch element is a transistor.

25. An array according to claim 1, wherein the array is an active matrix.

26. A method for refreshing pixel values of an array of pixels, each pixel comprising a pixel element comprising a first pixel electrode for individual control of the pixel element and a second pixel electrode, the second electrode of substantially all pixel elements in the array being connected to a common counter-electrode, the pixel element having a threshold voltage and a modulation voltage, the method comprising passively transferring charge related to pixel data to the first pixel electrode and applying a dynamically changing voltage to the common counter-electrode, the dynamically changing voltage changing between minus the threshold voltage of the pixel elements and the sum of the threshold voltage and the modulation voltage of the pixel elements so that the pixel data is a signal comprised between zero volts and a data voltage value, the data voltage value being not smaller than the modulation voltage and smaller than the sum of the modulation value and the threshold voltage of any of the pixel elements.

27. A method according to claim 26, furthermore comprising, before transferring the charge related to pixel data, storing the charge related to pixel data.

28. A method according to claim 27, furthermore comprising converting the stored charge into a pulse with a pulse width for control of the pixel element, the pulse width corresponding to an amount of stored charge.

29. A method according to claim 26, wherein passively transferring charge related to pixel data comprises transferring analog pixel data.

30. A method according to claim 26, wherein the transferring is synchronised with the applied dynamically changing voltage to the common counter-electrode.

31. A method according to claim 26, furthermore comprising pulsing light sources with different colours, wherein pulsing a light source with a new colour is synchronised with the transferring.

32. A method according to claim 26, furthermore comprising pulsing or scrolling temporally multiplexing light sources with different colours so as to obtain a colour change on the pixel element, transferring comprising a first transferring and a second transferring, wherein a the first transferring is synchronised with changes in the applied dynamically changing voltage to the common counter-electrode, and a the second transferring is synchronised with the colour change on the pixel element.

33. A method according to claim 32, furthermore comprising storing charge related to complementary pixel data.

34. A method according to claim 26, wherein the step of passively transferring pixel data comprises losslessly mirroring the data from a first memory element to the first pixel electrode of the pixel element.

35. A method according to claim 26, wherein the step of passively transferring pixel data comprises transferring the data from either of a set of memory elements over one switch element from a plurality of mutually exclusively driven switch elements.

* * * * *